US011375331B2

(12) United States Patent
Beack et al.

(10) Patent No.: US 11,375,331 B2
(45) Date of Patent: Jun. 28, 2022

(54) METHOD AND APPARATUS FOR CONTROL OF RANDERING MULTIOBJECT OR MULTICHANNEL AUDIO SIGNAL USING SPATIAL CUE

(71) Applicant: ELECTRONICS AND TELECOMMUNICATIONS RESEARCH INSTITUTE, Daejeon (KR)

(72) Inventors: Seung-Kwon Beack, Daejeon (KR); Jeong-Il Seo, Daejeon (KR); Dae-Young Jang, Daejeon (KR); Tae-Jin Lee, Daejeon (KR); Yong-Ju Lee, Daejeon (KR); Jin-Woo Hong, Daejeon (KR); Jin-Woong Kim, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 16/869,902

(22) Filed: May 8, 2020

(65) Prior Publication Data

US 2020/0267488 A1 Aug. 20, 2020

Related U.S. Application Data

(60) Continuation of application No. 16/356,410, filed on Mar. 18, 2019, now Pat. No. 10,652,685, which is a (Continued)

(30) Foreign Application Priority Data

Feb. 3, 2006 (KR) ..... 10-2006-0010559
Jul. 14, 2006 (KR) ..... 10-2006-0066488

(Continued)

(51) Int. Cl.
*H04S 7/00* (2006.01)
*G10L 19/008* (2013.01)

(52) U.S. Cl.
CPC ..... *H04S 7/30* (2013.01); *G10L 19/008* (2013.01); *H04S 2400/11* (2013.01)

(58) Field of Classification Search
CPC ..... H04S 7/30; H04S 2400/01; H04S 3/02; G10L 19/008; G10L 19/20; H03M 7/30
See application file for complete search history.

(56) References Cited

U.S. PATENT DOCUMENTS 10,652,685 B2 * 5/2020 Beack ..... G10L 19/008
2006/0165184 A1 * 7/2006 Purnhagen ..... H04S 5/02 375/242

(Continued)

FOREIGN PATENT DOCUMENTS

WO WO-2005101371 A1 * 10/2005 ..... G10L 19/167

*Primary Examiner* — Yogeshkumar Patel

(57) ABSTRACT

The present research relates to controlling rendering of multi-object or multi-channel audio signals. The present research provides a method and apparatus for controlling rendering of multi-object or multi-channel audio signals based on spatial cues in a process of decoding the multi-object or multi-channel audio signals. To achieve the purpose, the method suggested in the research controls rendering in a spatial cue domain in the process of decoding the multi-object or multi-channel audio signals.

8 Claims, 11 Drawing Sheets

Related U.S. Application Data continuation of application No. 13/568,584, filed on Aug. 7, 2012, now Pat. No. 10,277,999, which is a division of application No. 12/278,012, filed as application No. PCT/KR2007/000611 on Feb. 5, 2007, now Pat. No. 9,426,596.

(60) Provisional application No. 60/830,052, filed on Jul. 11, 2006, provisional application No. 60/819,907, filed on Jul. 11, 2006, provisional application No. 60/786,999, filed on Mar. 29, 2006.

(30) Foreign Application Priority Data

| | | |
|---|---|---|
| Jul. 25, 2006 | (KR) | 10-2006-0069961 |
| Jan. 8, 2007 | (KR) | 10-2007-0001996 |
| Feb. 5, 2007 | (KR) | 10-2007-0011643 |
| Jul. 31, 2012 | (KR) | 10-2012-0083964 |

(56) References Cited

U.S. PATENT DOCUMENTS

| | | | | |
|---|---|---|---|---|
| 2006/0190247 | A1* | 8/2006 | Lindblom | G10L 19/008 704/230 |
| 2007/0002971 | A1* | 1/2007 | Purnhagen | G10L 19/008 375/316 |
| 2008/0130904 | A1* | 6/2008 | Faller | G10L 19/008 381/17 |

* cited by examiner

METHOD AND APPARATUS FOR CONTROL OF RANDERING MULTIOBJECT OR MULTICHANNEL AUDIO SIGNAL USING SPATIAL CUE

TECHNICAL FIELD

The present invention relates to control of rendering multi-object or multi-channel audio signals; and more particularly to a method and apparatus for controlling the rendering of multi-object or multi-channel audio signals based on a spatial cue when the multi-object or multi-channel audio signals are decoded.

BACKGROUND ART

FIG. 1 illustrates an example of a conventional encoder for encoding multi-object or multi-channel audio signals. Referring to the drawing, a Spatial Audio Coding (SAC) encoder 101 is presented as an example of a conventional multi-object or multi-channel audio signal encoder, and it extracts spatial cues, which are to be described later, from the input signals, i.e., multi-object or multi-channel audio signals and transmits the spatial cues, while down-mixing the audio signals and transmits them in the form of mono or stereo signals.

SAC technology relates to a method of representing multi-object or multi-channel audio signals as down-mixed mono or stereo signals and spatial cue information, and transmitting and recovering them. The SAC technology can transmit high-quality multi-channel signals even at a low bit rate. The SAC technology focuses on analyzing multi-object or multi-channel audio signals according to each sub-band, and recovering original signals from the down-mixed signals based on the spatial cue information for each sub-band. Thus, the spatial cue information includes significant information needed for recovering the original signals in a decoding process, and the information becomes a major factor that determines the sound quality of the audio signals recovered in an SAC decoding device. Moving Picture Experts Group (MPEG) based on SAC technology is undergoing standardization in the name of MPEG Surround, and Channel Level Difference (CLD) is used as spatial cue.

The present invention is directed to an apparatus and method for controlling rendering of multi-object or multi-channel audio signals based on spatial cue transmitted from an encoder, while the multi-object or multi-channel audio signals are down-mixed and transmitted from the encoder and decoded.

Conventionally, a graphic equalizer equipped with a frequency analyzer was usually utilized to recover mono or stereo audio signals. The multi-object or multi-channel audio signals can be positioned diversely in a space. However, the positions of audio signals generated from the multi-object or multi-channel audio signals are recognized and recovered uniquely to a decoding device in the current technology.

DISCLOSURE

Technical Problem

An embodiment of the present invention is directed to providing an apparatus and method for controlling rendering of multi-object or multi-channel audio signals based on spatial cue, when the multi-object or multi-channel audio signals are decoded.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided an apparatus for controlling rendering of audio signals, which includes: a decoder for decoding an input audio signal, which is a down-mixed signal that is encoded in a Spatial Audio Coding (SAC) method, by using an SAC decoding method; and a spatial cue renderer for receiving spatial cue information and control information on rendering of the input audio signal and controlling the spatial cue information in a spatial cue domain based on the control information. Herein, the decoder performs rendering onto the input audio signals based on a controlled spatial cue information controlled by the spatial cue renderer.

In accordance with another aspect of the present invention, there is provided an apparatus for controlling rendering of audio signals, which includes: a decoder for decoding an input audio signal, which is a down-mixed signal encoded in an SAC method, by using the SAC method; and a spatial cue renderer for receiving spatial cue information and control information on the rendering of the input audio signal and controlling the spatial cue information in a spatial cue domain based on the control information. Herein, the decoder performs rendering of the input audio signal based on spatial cue information controlled by the spatial cue renderer, and the spatial cue information is a Channel Level Difference (CLD) value representing a level difference between input audio signals and expressed as $D_{CLD}^{Q}(ott,l,m)$. The spatial cue renderer includes: a CLD parsing unit for extracting a CLD parameter from a CLD transmitted from an encoder; a gain factor conversion unit for extracting a power gain of each audio signal from the CLD parameter extracted from the CLD parsing unit; and a gain factor control unit for calculating a controlled power gain by controlling a power gain of each audio signal extracted in the gain factor conversion unit based on control information on rendering of the input audio signal, m denoting an index of a sub-band and l denoting an index of a parameter set in the $D_{CLD}^{Q}(ott,l,m)$.

In accordance with another aspect of the present invention, there is provided an apparatus for controlling rendering of audio signals, which includes: a decoder for decoding an input audio signal, which is a down-mixed signal encoded in a Spatial Audio Coding (SAC) method, by using the SAC method; and a spatial cue renderer for receiving spatial cue information and control information on the rendering of the input audio signal and controlling the spatial cue information in a spatial cue domain based on the control information. Herein, the decoder performs rendering of the input audio signal based on spatial cue information controlled by the spatial cue renderer, and a center signal (C), a left half plane signal (Lf+Ls) and a right half plane signal (Rf+Rs) are extracted from the down-mixed signals L0 and R0, and the spatial cue information is a CLD value representing a level difference between input audio signals and expressed as $CLD_{LR/clfe}$, $CLD_{L/R}$, $CLD_{C/lfe}$, $CLD_{Lf/Ls}$ and $CLD_{Rf/Rs}$. The spatial cue renderer includes: a CLD parsing unit for extracting a CLD parameter from a CLD transmitted from an encoder; a gain factor conversion unit for extracting a power gain of each audio signal from the CLD parameter extracted from the CLD parsing unit; and a gain factor control unit for calculating a controlled power gain by controlling a power gain of each audio signal extracted in the gain factor conversion unit based on control information on rendering of the input audio signal.

In accordance with another aspect of the present invention, there is provided an apparatus for controlling rendering of audio signals, which includes: a decoder for decoding an input audio signal, which is a down-mixed signal encoded in an SAC method, by using the SAC method; and a spatial cue renderer for receiving spatial cue information and control information on the rendering of the input audio signal and controlling the spatial cue information in a spatial cue domain based on the control information. Herein, the decoder performs rendering of the input audio signal based on spatial cue information controlled by the spatial cue renderer, and the spatial cue information is a CLD value representing a Channel Prediction Coefficient (CPC) representing a down-mixing ratio of input audio signals and a level difference between input audio signals. The spatial cue renderer includes: a CPC/CLD parsing unit for extracting a CPC parameter and a CLD parameter from a CPC and a CLD transmitted from an encoder; a gain factor conversion unit for extracting power gains of each signal by extracting a center signal, a left half plane signal, and a right half plane signal from the CPC parameter extracted in the CPC/CLD parsing unit, and extracting power gains of left signal components and right signal components from the CLD parameter; and a gain factor control unit for calculating a controlled power gain by controlling a power gain of each audio signal extracted in the gain factor conversion unit based on control information on rendering of the input audio signal.

In accordance with another aspect of the present invention, there is provided an apparatus for controlling rendering of audio signals, which includes: a decoder for decoding an input audio signal, which is a down-mixed signal encoded in an SAC method, by using the SAC method; and a spatial cue renderer for receiving spatial cue information and control information on the rendering of the input audio signal and controlling the spatial cue information in a spatial cue domain based on the control information. Herein, the decoder performs rendering of the input audio signal based on spatial cue information controlled by the spatial cue renderer, and the spatial cue information is an Inter-Channel Correlation (ICC) value representing a correlation between input audio signals, and the spatial cue renderer controls an ICC parameter through a linear interpolation process.

In accordance with another aspect of the present invention, there is provided a method for controlling rendering of audio signals, which includes the steps of: a) decoding an input audio signal, which is a down-mixed signal that is encoded in an SAC method, by using an SAC decoding method; and b) receiving spatial cue information and control information on rendering of the input audio signals and controlling the spatial cue information in a spatial cue domain based on the control information. Herein, rendering is performed in the decoding step a) onto the input audio signals based on a controlled spatial cue information controlled in the spatial cue rendering step b).

In accordance with another aspect of the present invention, there is provided a method for controlling rendering of audio signals, which includes the steps of: a) decoding an input audio signal, which is a down-mixed signal encoded in an SAC method, by using the SAC method; and b) receiving spatial cue information and control information on the rendering of the input audio signal and controlling the spatial cue information in a spatial cue domain based on the control information. Herein, rendering of the input audio signal is performed in the decoding step a) based on spatial cue information controlled in the spatial cue rendering step b), and the spatial cue information is a CLD value representing a level difference between input audio signals and expressed as $D_{CLD}^{Q}(ott,l,m)$. Herein, the spatial cue rendering step b) includes the steps of: b1) extracting a CLD parameter from a CLD transmitted from an encoder; b2) extracting a power gain of each audio signal from the CLD parameter extracted from the CLD parsing step b1); and b3) calculating a controlled power gain by controlling a power gain of each audio signal extracted in the gain factor conversion step b2) based on control information on rendering of the input audio signal, m denoting an index of a sub-band and l denoting an index of a parameter set in the $D_{CLD}^{Q}(ott,l,m)$.

In accordance with another aspect of the present invention, there is provided a method for controlling rendering of audio signals, which includes the steps of: a) decoding an input audio signal, which is a down-mixed signal encoded in an SAC method, by using the SAC method; and b) receiving spatial cue information and control information on the rendering of the input audio signal and controlling the spatial cue information in a spatial cue domain based on the control information. Herein, rendering of the input audio signal is performed in the decoding step a) based on spatial cue information controlled in the spatial cue rendering step b), and a center signal (C), a left half plane signal (Lf+Ls) and a right half plane signal (Rf+Rs) are extracted from the down-mixed signals L0 and R0, and the spatial cue information is a CLD value representing a level difference between input audio signals and expressed as $CLD_{LR/Clfe}$, $CLD_{L/R}$, $CLD_{C/lfe}$, $CLD_{Lf/Ls}$ and $CLD_{Rf/Rs}$. The spatial cue rendering step b) includes the steps of: b1) extracting a CLD parameter from a CLD transmitted from an encoder; b2) extracting a power gain of each audio signal from the CLD parameter extracted in the CLD parsing step b1); and b3) calculating a controlled power gain by controlling a power gain of each audio signal extracted in the gain factor conversion step b2) based on control information on rendering of the input audio signal.

In accordance with another aspect of the present invention, there is provided a method for controlling rendering of audio signals, which includes the steps of: a) decoding an input audio signal, which is a down-mixed signal encoded in an SAC method, by using the SAC method; and b) receiving spatial cue information and control information on the rendering of the input audio signal and controlling the spatial cue information in a spatial cue domain based on the control information. Herein, rendering of the input audio signal is performed in the decoding step a) based on spatial cue information controlled in the spatial cue rendering step b), and the spatial cue information is a CPC representing a down-mixing ratio of input audio signals and a CLD value representing a level difference between input audio signals. Herein, the spatial cue rendering step b) includes: b1) extracting a CPC parameter and a CLD parameter from a CPC and a CLD transmitted from an encoder; b2) extracting power gains of each signal by extracting a center signal, a left half plane signal, and a right half plane signal from the CPC parameter extracted in the CPC/CLD parsing step b1), and extracting a power gain of a left signal component and a right signal component from the CLD parameter; and b3) calculating a controlled power gain by controlling a power gain of each audio signal extracted in the gain factor conversion step b2) based on control information on rendering of the input audio signal.

In accordance with another aspect of the present invention, there is provided a method for controlling rendering of audio signals, which includes the steps of: a) decoding an input audio signal, which is a down-mixed signal encoded in an SAC method, by using the SAC method; and b) receiving spatial cue information and control information on the rendering of the input audio signal and controlling the spatial cue information in a spatial cue domain based on the control information. Herein, rendering of the input audio signal is performed in the decoding step a) based on spatial cue information controlled in the spatial cue rendering step b), and the spatial cue information is an Inter-Channel Correlation (ICC) value representing a correlation between input audio signals, and an ICC parameter is controlled in the spatial cue rendering step b) through a linear interpolation process.

According to the present invention, it is possible to flexibly control the positions of multi-object or multi-channel audio signals by directly controlling spatial cues upon receipt of a request from a user or an external system in communication.

Advantageous Effects

The present invention provides an apparatus and method for controlling rendering of multi-object or multi-channel signals based on spatial cues when the multi-object or multi-channel audio signals are decoded.

BEST MODE FOR THE INVENTION

Figure 1:
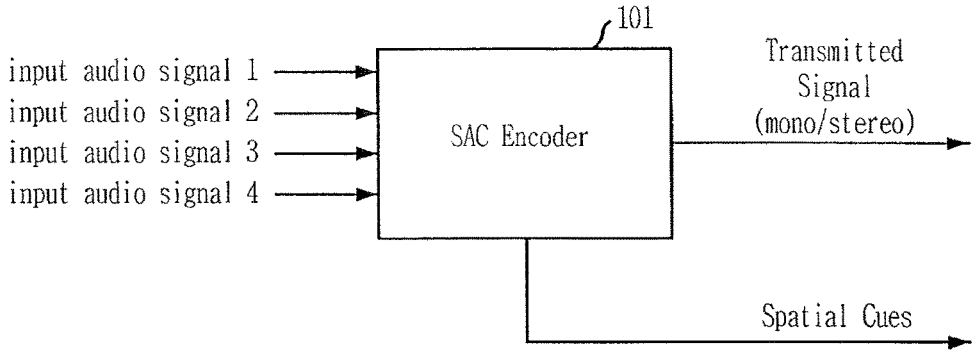
FIG. 1 is an exemplary view showing a conventional multi-object or multi-channel audio signal encoder.

Following description exemplifies only the principles of the present invention. Even if they are not described or illustrated clearly in the present specification, one of ordinary skill in the art can embody the principles of the present invention and invent various apparatuses within the concept and scope of the present invention. The use of the conditional terms and embodiments presented in the present specification are intended only to make the concept of the present invention understood, and they are not limited to the embodiments and conditions mentioned in the specification.

In addition, all the detailed description on the principles, viewpoints and embodiments and particular embodiments of the present invention should be understood to include structural and functional equivalents to them. The equivalents include not only currently known equivalents but also those to be developed in future, that is, all devices invented to perform the same function, regardless of their structures.

For example, block diagrams of the present invention should be understood to show a conceptual viewpoint of an exemplary circuit that embodies the principles of the present invention. Similarly, all the flowcharts, state conversion diagrams, pseudo codes and the like can be expressed substantially in a computer-readable media, and whether or not a computer or a processor is described distinctively, they should be understood to express various processes operated by a computer or a processor.

Functions of various devices illustrated in the drawings including a functional block expressed as a processor or a similar concept can be provided not only by using hardware dedicated to the functions, but also by using hardware capable of running proper software for the functions. When a function is provided by a processor, the function may be provided by a single dedicated processor, single shared processor, or a plurality of individual processors, part of which can be shared.

The apparent use of a term, 'processor', 'control' or similar concept, should not be understood to exclusively refer to a piece of hardware capable of running software, but should be understood to include a digital signal processor (DSP), hardware, and ROM, RAM and non-volatile memory for storing software, implicatively. Other known and commonly used hardware may be included therein, too.

Similarly, a switch described in the drawings may be presented conceptually only. The function of the switch should be understood to be performed manually or by controlling a program logic or a dedicated logic or by interaction of the dedicated logic. A particular technology can be selected for deeper understanding of the present specification by a designer.

In the claims of the present specification, an element expressed as a means for performing a function described in the detailed description is intended to include all methods for performing the function including all formats of software, such as combinations of circuits for performing the intended function, firmware/microcode and the like.

To perform the intended function, the element is cooperated with a proper circuit for performing the software. The present invention defined by claims includes diverse means for performing particular functions, and the means are connected with each other in a method requested in the claims. Therefore, any means that can provide the function should be understood to be an equivalent to what is figured out from the present specification.

The advantages, features and aspects of the invention will become apparent from the following description of the embodiments with reference to the accompanying drawings, which is set forth hereinafter. If further detailed description on the related prior arts is determined to obscure the point of the present invention, the description is omitted. Hereafter, preferred embodiments of the present invention will be described in detail with reference to the drawings.

Figure 2:
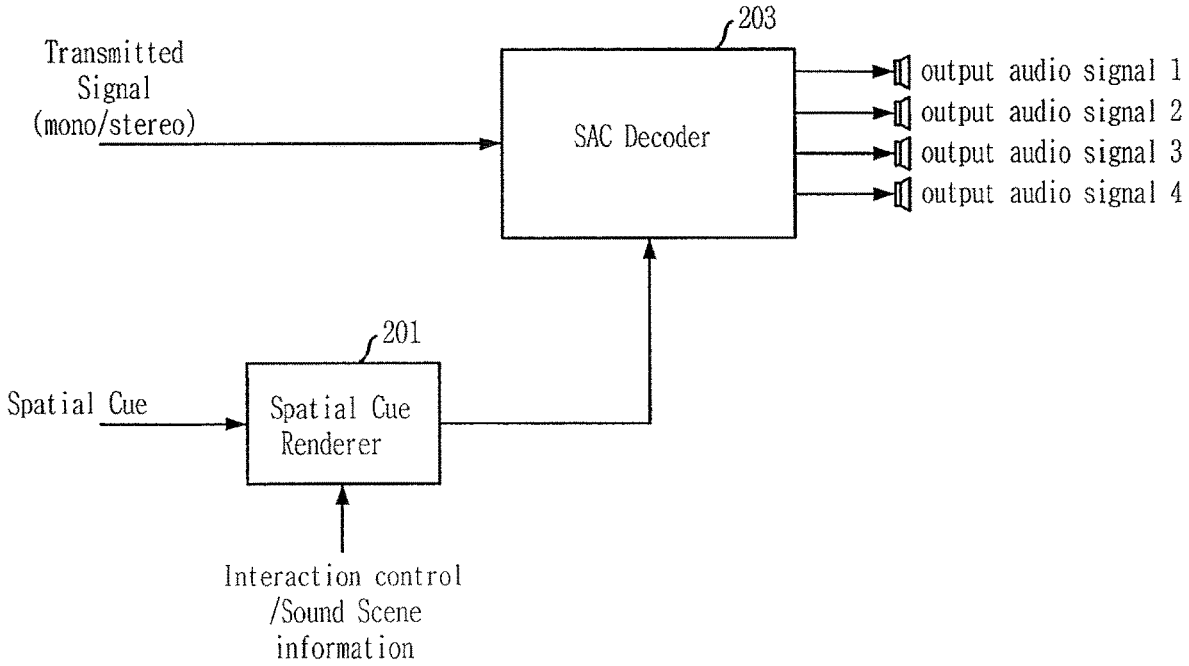
FIG. 2 shows an audio signal rendering controller in accordance with an embodiment of the present invention.

FIG. 2 shows an audio signal rendering controller in accordance with an embodiment of the present invention. Referring to the drawing, the audio signal rendering controller employs a Spatial Audio Coding (SAC) decoder 203, which is a constituent element corresponding to the SAC encoder 101 of FIG. 1, and it includes a spatial cue renderer 201 additionally.

A signal inputted to the SAC decoder 203 is a down-mixed mono or stereo signal transmitted from an encoder, e.g., the SAC encoder of FIG. 1. A signal inputted to the spatial cue renderer 201 is a spatial cue transmitted from the encoder, e.g., the SAC encoder of FIG. 1.

The spatial cue renderer 201 controls rendering in a spatial cue domain. To be specific, the spatial cue renderer 201 perform rendering not by directly controlling the output signal of the SAC decoder 203 but by extracting audio signal information from the spatial cue.

Herein, the spatial cue domain is a parameter domain where the spatial cue transmitted from the encoder is recognized and controlled as a parameter. Rendering is a process of generating output audio signal by determining the position and level of an input audio signal.

The SAC decoder 203 may adopt such a method as MPEG Surround, Binaural Cue Coding (BCC) and Sound Source Location Cue Coding (SSLCC), but the present invention is not limited to them.

According to the embodiment of the present invention, applicable spatial cues are defined as:

- Channel Level Difference (CLD): Level difference between input audio signals
- Inter-Channel Correlation (ICC): Correlation between input audio signals
- Channel Prediction Coefficient (CPC): Down-mixing ratio of an input audio signal In other words, the CDC is power gain information of an audio signal, and the ICC is correlation information between audio signals. The CTD is time difference information between audio signals, and the CPC is down-mixing gain information of an audio signal.

Major role of a spatial cue is to maintain a spatial image, i.e., a sound scene. According to the present invention, a sound scene can be controlled by controlling the spatial cue parameters instead of directly manipulating an audio output signal.

When the reproduction environment of an audio signal is taken into consideration, the mostly used spatial cue is CLD, which alone can generate a basic output signal. Hereinafter, technology for controlling signals in a spatial cue domain will be described based on CLD as an embodiment of the present invention. The present invention, however, is not limited to the CLD and it is obvious to those skilled in the art to which the present invention pertains. Therefore, it should be understood that the present invention is not limited to the use of CLD.

According to an embodiment using CLD, multi-object and multi-channel audio signals can be panned by directly applying a law of sound panning to a power gain coefficient.

Figure 3:
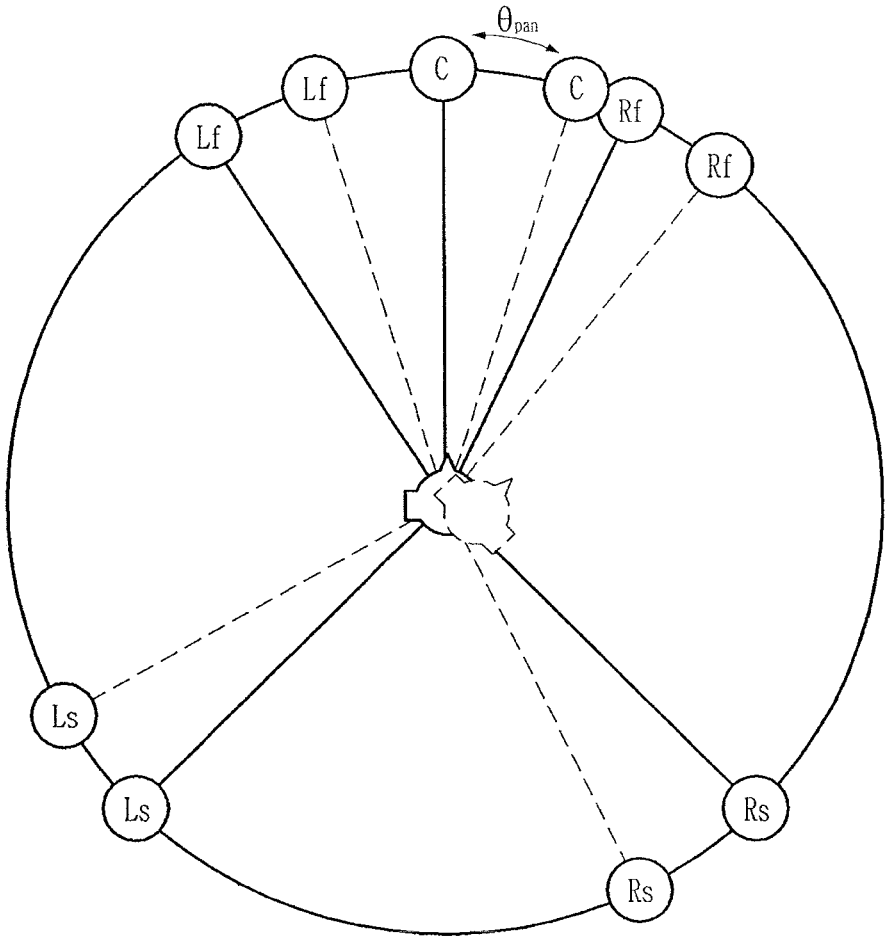
FIG. 3 is an exemplary view illustrating a recovered panning multi-channel signal.

According to the embodiment, multi-object and multi-channel audio signals can be recovered based on the panning position in the entire band by controlling the spatial cue. The CLD is manipulated to assess the power gain of each audio signal corresponding to a desired panning position. The panning position may be freely inputted through interaction control signals inputted from the outside. FIG. 3 is an exemplary view illustrating a recovered panning multi-channel signal. Each signal is rotated at a given angle $\theta_{pan}$. Then, the user can recognize rotated sound scenes. In FIG. 3, Lf denotes a left front channel signal; Ls denotes a left rear channel signal; Rf denotes a right front channel signal, Rs denotes a right rear channel signal; C denotes a central channel signal. Thus, [Lf+Ls] denotes left half-plane signals, and [Rf+Rs] denotes right half-plane signals. Although not illustrated in FIG. 3, lfe indicates a woofer signal.

Figure 4:
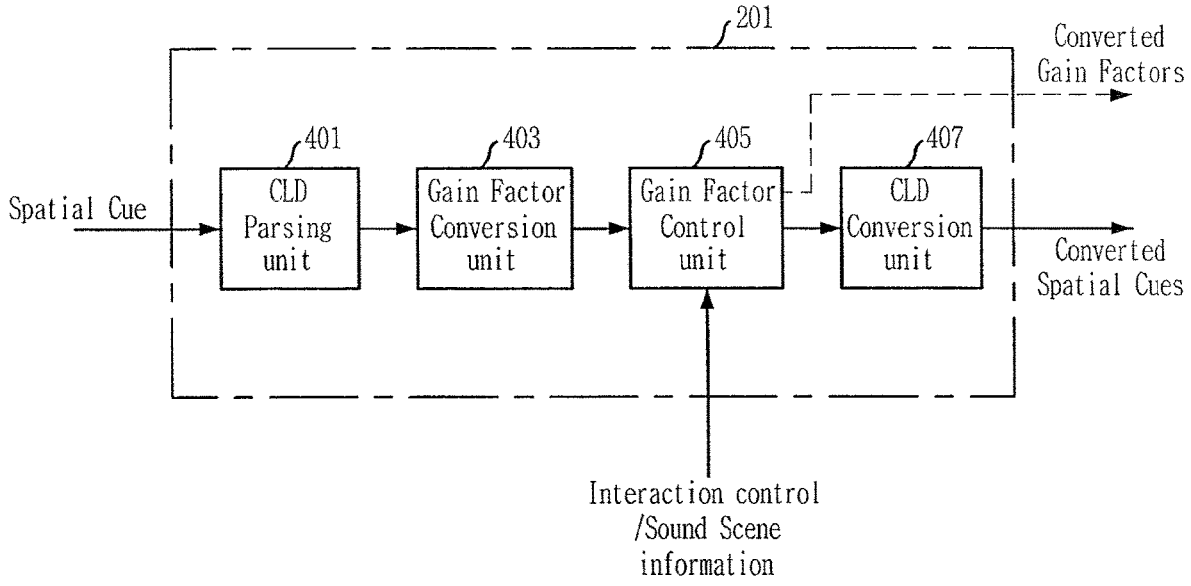
FIG. 4 is a block diagram describing a spatial cue renderer shown in FIG. 2 when Channel Level Difference (CLD) is utilized as a spatial cue in accordance with an embodiment of the present invention.

FIG. 4 is a block diagram describing a spatial cue renderer shown in FIG. 2 when CLD is utilized as a spatial cue in accordance with an embodiment of the present invention.

Referring to the drawing, the spatial cue renderer 201 using CLD as a spatial cue includes a CLD parsing unit 401, a gain factor conversion unit 403, a gain factor control unit 405, and a CLD conversion unit 407.

The CLD parsing unit 401 extracts a CLD parameter from a received spatial cue, i.e., CLD. The CLD includes level difference information of audio signals and it is expressed as:

$$CLD_m^i = 10\log_{10}\frac{P_m^k}{P_m^i} \quad \text{Equation 1}$$

where $P_m^k$ denotes a sub-band power for a $k^{th}$ input audio signal in an $m^{th}$ sub-band.

The gain factor conversion unit 403 extracts power gain of each audio signal from the CLD parameter obtained in the CLD parsing unit 401.

Referring to Equation 1, when M audio signals are inputted in the $m^{th}$ sub-band, the number of CLDs that can be extracted in the $m^{th}$ sub-band is M−1 ($1 \le i \le M-1$)). Therefore, the power gain of each audio signal is acquired from the OLD based on Equation 2 expressed as:

$$g_m^j = \frac{1}{\sqrt{1+10^{CLD_m^j/10}}} = \frac{\sqrt{P_m^j}}{\sqrt{P_m^k+P_m^j}} \quad \text{Equation 2}$$

$$g_m^k = g_m^j \cdot 10^{CLD_m^j/20} = \frac{\sqrt{P_m^j}}{\sqrt{P_m^k+P_m^j}}$$

Therefore, power gain of the M input audio signal can be acquired from the M−1 CLD in the $m^{th}$ sub-band.

Meanwhile, since the spatial cue is extracted on the basis of a sub-band of an input audio signal, power gain is extracted on the sub-band basis, too. When the power gains of all input audio signals in the $m^{th}$ sub-band are extracted, they can be expressed as a vector matrix shown in Equation 3:

$$G_m = \begin{bmatrix} g_m^1 \\ g_m^2 \\ \vdots \\ g_m^M \end{bmatrix} \quad \text{Equation 3}$$

where m denotes a sub-band index;

$g_m^k$ denotes a sub-band power gain for a $k^{th}$ input audio signal ($1 \le k \le M$) in the $m^{th}$ sub-band; and $G_m$ denotes a vector indicating power gain of all input audio signals in the $m^{th}$ sub-band.

The power gain ($G_m$) of each audio signal extracted in the gain factor conversion unit is inputted into the gain factor control unit 405 and adjusted. The adjustment controls the rendering of the input audio signal and, eventually, forms a desired audio scene.

Rendering information inputted to the gain factor control unit 405 includes the number (N) of input audio signals, virtual position and level of each input audio signal including burst and suppression, and the number (M) of output audio signals, and virtual position information. The gain factor control unit 405 receives control information on the rendering of the input audio signals, which is audio scene information includes output position and output level of an input audio signal. The audio scene information is an interaction control signal inputted by a user outside. Then, the gain factor control unit 405 adjusts the power gain ($G_m$) of each input audio signal outputted from the gain factor conversion unit 403, and acquires a controlled power gain (${}_{out}G_m$) as shown in Equation 4.

$${}_{out}G_m = \begin{bmatrix} {}_{out}g_m^1 \\ {}_{out}g_m^2 \\ \vdots \\ {}_{out}g_m^M \end{bmatrix} \quad \text{Equation 4}$$

For example, when a suppression directing that the level for the first output audio signal (${}_{out}g_m^1$) in the $m^{th}$ sub-band is inputted as rendering control information, the gain factor control unit 405 calculates a controlled power gain (${}_{out}G_m$) based on the power gain ($G_m$) of each audio signal outputted from the gain factor conversion unit 403 as shown in Equation 5.

$${}_{out}G_m = \begin{bmatrix} {}_{out}g_m^1 \\ {}_{out}g_m^2 \\ \vdots \\ {}_{out}g_m^M \end{bmatrix} = \begin{bmatrix} 0 \\ g_m^2 \\ \vdots \\ g_m^M \end{bmatrix} \quad \text{Equation 5}$$

When it is expressed more specifically, it equals to the following Equation 6.

$${}_{out}G_m = \begin{bmatrix} {}_{out}g_m^1 \\ {}_{out}g_m^2 \\ \vdots \\ {}_{out}g_m^M \end{bmatrix} = \overbrace{\begin{bmatrix} 0 & 0 & \dots & 0 \\ 0 & 1 & \dots & 0 \\ \vdots & \vdots & \ddots & \vdots \\ 0 & 0 & \dots & 1 \end{bmatrix}}^{M} \begin{bmatrix} g_m^1 \\ g_m^2 \\ \vdots \\ g_m^M \end{bmatrix} \quad \text{Equation 6}$$

In other words, the level of the first output audio signal (${}_{out}G_m^1$) in the $m^{th}$ sub-band can be eliminated by adjusting the factor of the first input audio signal ($g_m^1$) in the $m^{th}$ sub-band of a matrix to be 0. This is referred to as suppression.

Likewise, it is possible to burst the level of a particular output audio signal. After all, according to an embodiment of the present invention, the output level of an output audio signal can be controlled by changing the power gain value obtained based on a spatial cue.

As another embodiment of the present invention, when rendering information directing that the first input audio signal ($g_m^1$) of the $m^{th}$ sub-band should be positioned between the first output audio signal (${}_{out}g_m^1$) and the second output audio signal (${}_{out}g_m^2$) of the $m^{th}$ sub-band (e.g., angle information on a plane, $\theta=45°$) is inputted to the gain factor control unit 405, the gain factor control unit 405 calculates a controlled power gain (${}_{out}G_m$) based on the power gain ($G_m$) of each audio signal outputted from the gain factor conversion unit 403 as shown in Equation 7.

$${}_{out}G_m = \begin{bmatrix} {}_{out}g_m^1 \\ {}_{out}g_m^2 \\ \vdots \\ {}_{out}g_m^M \end{bmatrix} = \begin{bmatrix} g_m^1 \times \frac{1}{\sqrt{2}} \\ g_m^1 \times \frac{1}{\sqrt{2}} + g_m^2 \\ \vdots \\ g_m^M \end{bmatrix} \quad \text{Equation 7}$$

This can be specifically expressed as the following Equation 8.

$${}_{out}G_m = \begin{bmatrix} {}_{out}g_m^1 \\ {}_{out}g_m^2 \\ \vdots \\ {}_{out}g_m^M \end{bmatrix} = \overbrace{\begin{bmatrix} \frac{1}{\sqrt{2}} & 0 & \dots & 0 \\ \frac{1}{\sqrt{2}} & 1 & \dots & 0 \\ \vdots & \vdots & \ddots & \vdots \\ 0 & 0 & \dots & 1 \end{bmatrix}}^{M} \begin{bmatrix} g_m^1 \\ g_m^2 \\ \vdots \\ g_m^M \end{bmatrix} \quad \text{Equation 8}$$

A generalized embodiment of the method mapping an input audio signal between output audio signals is a mapping method adopting a Panning Law. Panning Law includes Sine Panning Law, Tangent Panning Law, and Constant Power Panning Law (CPP Law). Whatever the sort of the Panning Law is, what is to be achieved by the Panning Law is the same.

Hereinafter, a method of mapping an audio signal at a desired position based on the CPP in accordance with an embodiment of the present invention. However, the present invention is not limited only to the use of CPP, and it is obvious to those skilled in the art of the present invention that the present invention is not limited to the use of the CPP.

According to an embodiment of the present invention, all multi-object or multi-channel audio signals are panned based on the CPP for a given panning angle. Also, the CPP is not applied to an output audio signal but it is applied to power gain extracted from CLD values to utilize a spatial cue. After the CPP is applied, a controlled power gain of an audio signal is converted into CLD, which is transmitted to the SAC decoder 203 to thereby produce a panned multi-object or multi-channel audio signal.

Figure 5:
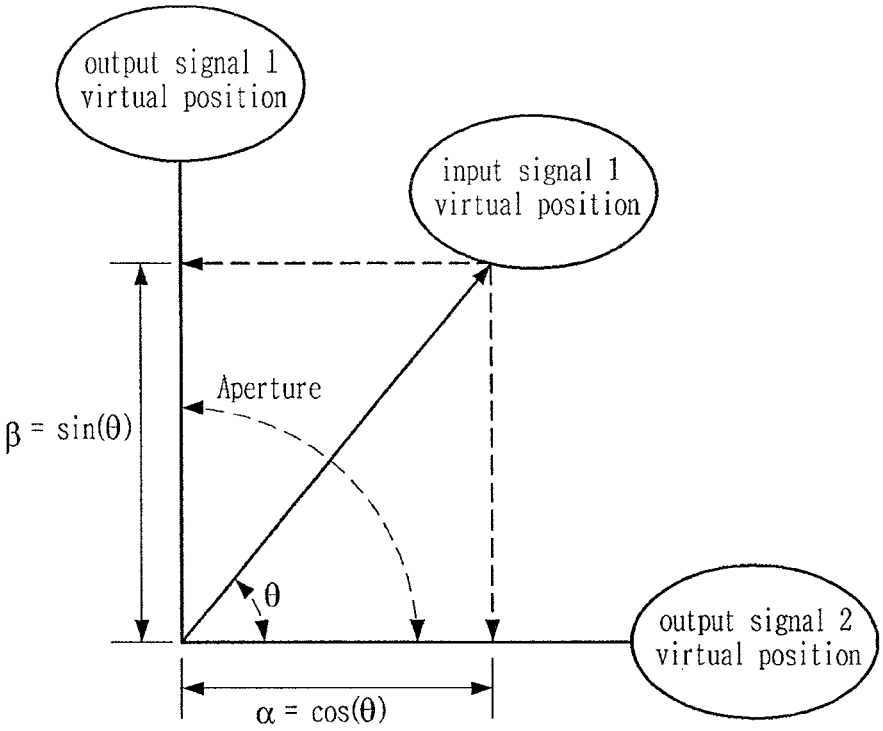
FIG. 5 illustrates a method of mapping audio signals to desired positions by utilizing Constant Power Panning (CPP).

FIG. 5 illustrates a method of mapping audio signals to desired positions by utilizing CPP in accordance with an embodiment of the present invention. As illustrated in the drawing, the positions of output signals 1 and 2 (${}_{out}g_m^1$ and ${}_{out}g_m^2$) are 0° and 90°, respectively. Thus, an aperture is 90° in FIG. 5.

When the first input audio signal ($g_m^1$) is positioned at θ between output signals 1 and 2 (${}_{out}g_m^1$ and ${}_{out}g_m^2$), α,β values are defined as α=cos(θ), β=sin(θ), respectively. According to the CPP Law, the position of an input audio signal is projected onto an axis of the output audio signal, and the α,β values are calculated by using sine and cosine functions. Then, a controlled power gain is obtained and the rendering of an audio signal is controlled. The controlled power gain (${}_{out}G_m$) acquired based on the α,β values is expressed as Equation 9.

$$ {}_{out}G_m = \begin{bmatrix} {}_{out}g_m^1 \\ {}_{out}g_m^2 \\ \vdots \\ {}_{out}g_m^M \end{bmatrix} = \begin{bmatrix} g_m^1 \times \beta \\ g_m^1 \times \alpha + g_m^2 \\ \vdots \\ g_m^M \end{bmatrix} \quad \text{Equation 9} $$

where α=cos(θ),β=sin(θ).

The Equation 9 can be specifically expressed as the following Equation 10.

$$ {}_{out}G_m = \begin{bmatrix} {}_{out}g_m^1 \\ {}_{out}g_m^2 \\ \vdots \\ {}_{out}g_m^M \end{bmatrix} = \overbrace{\begin{bmatrix} \beta & 0 & \dots & 0 \\ \alpha & 1 & \dots & 0 \\ \vdots & \vdots & \ddots & \vdots \\ 0 & 0 & \dots & 1 \end{bmatrix}}^{M} \begin{bmatrix} g_m^1 \\ g_m^2 \\ \vdots \\ g_m^M \end{bmatrix} \quad \text{Equation 10} $$

where the α,β values may be different according to a Panning Law applied thereto.

The α,β values are acquired by mapping the power gain of an input audio signal to a virtual position of an output audio signal so that they conform to predetermined apertures.

According to an embodiment of the present invention, rendering can be controlled to map an input audio signal to a desired position by controlling a spatial cue, such as power gain information of the input audio signal, in the spatial cue domain.

In the above, a case where the number of the power gains of input audio signals is the same as the number of the power gains of output audio signals has been described. When the number of the power gains of the input audio signals is different from the number of the power gains of the output audio signals, which is a general case, the dimension of the matrixes of the Equations 6, 8 and 1 is expressed not as M×M but as M×N.

For example, when the number of output audio signals is 4 (M=4) and the number of input audio signals is 5 (N=5) and when rendering control information (e.g., the position of input audio signal and the number of output audio signals) is inputted to the gain factor controller 405, the gain factor controller 405 calculates a controlled power gain (${}_{out}G_m$) from the power gain ($G_m$) of each audio signal outputted from the gain factor conversion unit 403.

$$ {}_{out}G_m = \begin{bmatrix} {}_{out}g_m^1 \\ {}_{out}g_m^2 \\ {}_{out}g_m^3 \\ {}_{out}g_m^M \end{bmatrix} = \begin{bmatrix} \beta_1 & 0 & 0 & 0 & \alpha_5 \\ \alpha_1 & \beta_2 & 0 & \alpha_4 & 0 \\ 0 & 0 & \beta_3 & 0 & \beta_5 \\ 0 & \alpha_2 & \alpha_3 & \beta_4 & 0 \end{bmatrix} \begin{bmatrix} g_m^1 \\ g_m^2 \\ g_m^3 \\ g_m^4 \\ g_m^5 \end{bmatrix} \quad \text{Equation 11} $$

According to the Equation 11, N (N=5) input audio signals are mapped to M (M=4) output audio signals as follows. The first input audio signal ($g_m^1$) is mapped between output audio signals 1 and 2 (${}_{out}g_m^1$ and ${}_{out}g_m^2$) based on the $\alpha_1,\beta_1$ values. The second input audio signal ($g_m^2$) is mapped between output audio signals 2 and 4 (${}_{out}g_m^2$ and ${}_{out}g_m^4$) based on the $\alpha_2,\beta_2$ values. The third input audio signal ($g_m^3$) is mapped between output audio signals 3 and 4 (${}_{out}g_m^3$ and ${}_{out}g_m^4$) based on $\alpha_3,\beta_3$ values. The fourth input audio signal $g_m^4$) is mapped between output audio signals 2 and 4 (${}_{out}g_m^2$ and ${}_{out}g_m^4$) based on $\alpha_4,\beta_4$ values. The fifth input audio signal ($g_m^5$) is mapped between output audio signals 1 and 3 (${}_{out}g_m^1$ and ${}_{out}g_m^3$) based on $\alpha_5,\beta_5$ values.

In short, when the α,β values for mapping a $g_m^k$ value (where k is an index of an input audio signal, k=1, 2, 3, 4, 5) between predetermined output audio signals are defined as $\alpha_k$, $\beta_k$, N (N=5) input audio signals can be mapped to M (M=4) output audio signals. Hence, the input audio signals can be mapped to desired positions, regardless of the number of the output audio signals.

To make the output level of the $k^{th}$ input audio signal a 0 value, the $\alpha_k,\beta_k$ values are set 0, individually, which is suppression.

The controlled power gain (${}_{out}G_m$) outputted from the gain factor controller 405 is converted into a CLD value in the CLD conversion unit 407. The CLD conversion unit 407 converts the controlled power gain (${}_{out}G_m$) shown in the following Equation 12 into a converted CLD value, which is $CLD_m^i$, through calculation of common logarithm. Since the controlled power gain (${}_{out}G_m$) is a power gain, 20 is multiplied.

$$ \text{converted } CLD_m^i = 20\log_{10}\frac{{}_{out}g_m^k}{{}_{out}g_m^j} \quad \text{Equation 12} $$

where the $CLD_m^i$ value acquired in the CLD conversion unit 407 is acquired from a combination of factors of the control power gain (${}_{out}G_m$), and a compared signal (${}_{out}g_m^k$ or ${}_{out}g_m^j$) does not have to correspond to a signal ($P_m^k$ or $P_m^j$) for calculating the input CLD value. Acquisition of the converted CLD value ($CLD_m^i$) from M−1 combinations to express the controlled power gain (${}_{out}G_m$) may be sufficient.

The converted signal ($CLD_m^i$) acquired in the CLD conversion unit 407 is inputted into the SAC decoder 203.

Hereinafter, the operations of the above-described gain factor conversion unit 403, gain factor control unit 405, and CLD conversion unit 407 will be described according to another embodiment of the present invention.

The gain factor conversion unit 403 extracts the power gain of an input audio signal from CLD parameters extracted in the CLD parsing unit 401. The CLD parameters are converted into gain coefficients of two input signals for each sub-band. For example, in case of a mono signal transmission mode called 5152 mode, the gain factor conversion unit 403 extracts power gains ($G_{0,l,m}^{Clfe}$ and $G_{0,l,m}^{LR}$) from the CLD parameters ($D_{CLD}^{Q}$(ott,l,m)) based on the following Equation 13. Herein, the 5152 mode is disclosed in detail in an International Standard MPEG Surround (WD N7136, 23003-1:2006/FDIS) published by the ISO/IEC JTC (International Organization for Standardization International Electrotechnical Commission Joint Technical Committee) in February, 2005. Since the 5152 mode is no more than a mere embodiment for describing the present invention, detailed description on the 5152 mode will not be provided herein. The aforementioned International Standard occupies part of the present specification within a range that it contributes to the description of the present invention.

$$G_{0,l,m}^{Clfe} = \frac{1}{\sqrt{1 + 10^{D_{CLD}^{Q}(0,l,m)/10}}}$$

$$G_{0,l,m}^{LR} = G_{0,l,m}^{Clfe} \cdot 10^{D_{CLD}^{Q}(0,l,m)/20} \quad \text{Equation 13}$$

where m denotes an index of a sub-band;

l denotes an index of a parameter set; and

Clfe and LR denote a summation of a center signal and an woofer (lfe) signal and a summation of a left plane signal (Ls+Lf) and a right plane signal (Rs+Rf), respectively.

According to an embodiment of the present invention, power gains of all input audio signals can be calculated based on the Equation 13.

Subsequently, the power gain (pG) of each sub-band can be calculated from multiplication of the power gain of the input audio signals based on the following Equation 14.

$$pG_{l,m}^{Lf} = G_{1,l,m}^{L} \cdot G_{3,l,m}^{Lf}$$

$$pG_{l,m}^{Ls} = G_{1,l,m}^{L} \cdot G_{3,l,m}^{Ls}$$

$$pG_{l,m}^{Rf} = G_{1,l,m}^{R} \cdot G_{4,l,m}^{Rf}$$

$$pG_{l,m}^{Rs} = G_{1,l,m}^{R} \cdot G_{4,l,m}^{Rs}$$

$$pG_{l,m}^{C} = G_{1,l,m}^{Clfe}, pG_{l,m}^{lfe} = 0 (m>1)$$

$$pG_{l,m}^{lfe} = G_{1,l,m}^{Clfe} \cdot G_{2,l,m}^{lfe}, pG_{l,m}^{C} = G_{1,l,m}^{Clfe} \cdot G_{2,l,m}^{C} \quad (m=0,1) \quad \text{Equation 14}$$

Subsequently, the channel gain (pG) of each audio signal extracted from the gain factor conversion unit 403 is inputted into the gain factor control unit 405 to be adjusted. Since rendering of the input audio signal is controlled through the adjustment, a desired audio scene can be formed eventually.

According to an embodiment, the CPP Law is applied to a pair of adjacent channel gains. First, a $\theta_m$ value is control information for rendering of an input audio signal and it is calculated from a given $\theta_{pan}$ value based on the following Equation 15.

$$\theta_m = \frac{(\theta_{pan} - \theta_1)}{(\text{apeture} - \theta_1)} \times \frac{\pi}{2} \quad \text{Equation 15}$$

Figure 6:
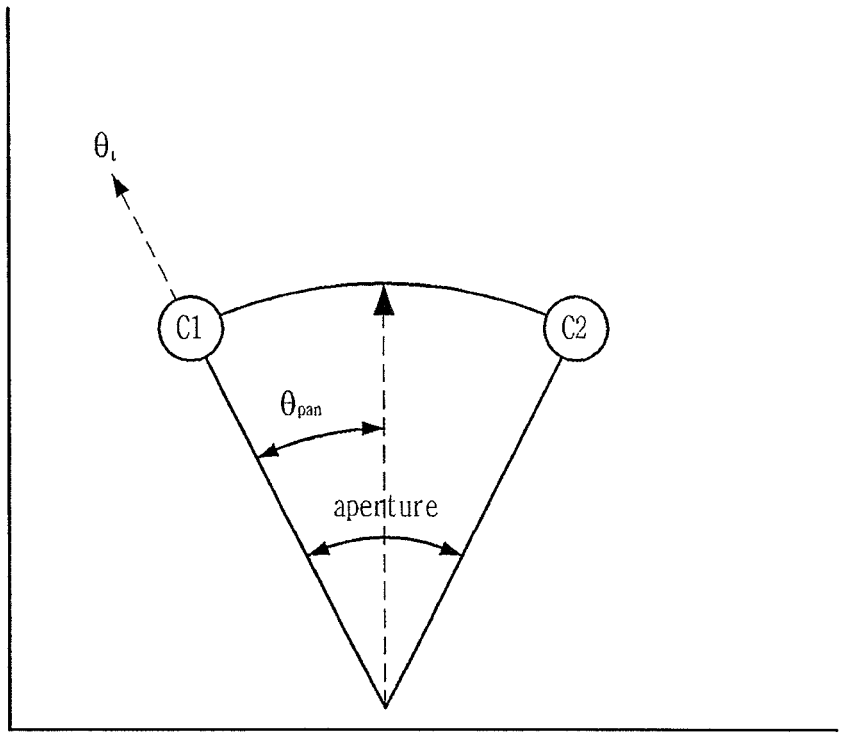
FIG. 6 schematically shows a layout including angular relationship between signals.

Herein, an aperture is an angle between two output signals and a $\theta_1$ value ($\theta_1$=0) is an angle of the position of a reference output signal. For example, FIG. 6 schematically shows a stereo layout including the relationship between the angles.

Therefor a panning gain based on the control information ($\theta_{pan}$) for the rendering of an input audio signal is defined as the following Equation 16.

$$pG_{c1} = \cos(\theta_m)$$

$$pG_{c2} = \sin(\theta_m) \quad \text{Equation 16}$$

Of course, the aperture angle varies according to the angle between output signals. The aperture angle is 30° when the output signal is a front pair (C and Lf or C and Rf); 80° when the output signal is a side pair (Lf and Ls or Rf and Rs); and 140° when the output signal is a rear pair (Ls and Rs). For all input audio signals in each sub-band, controlled power gains (e.g., ${}_{out}G_m$ of the Equation 4) controlled based on the CPP Law are acquired according to the panning angle.

The controlled power gain outputted from the gain factor control unit 405 is converted into a OLD value in the CLD conversion unit 407. The CLD conversion unit 407 is converted into a $D_{CLD}^{modified}$ value, which is a CLD value, corresponding to the $CLD_m^i$ value, which is a converted CLD value, through calculation of common logarithm on the controlled power gain, which is expressed in the following Equation 17. The OLD value ($D_{CLD}^{modified}$) is inputted into the SAC decoder 203.

$$D_{CLD}^{modified}(0, l, m) = 20\log_{10}\left(\frac{pG_{Lf}(l, m)}{pG_{Ls}(l, m)}\right) \quad \text{Equation 17}$$

$$D_{CLD}^{modified}(1, l, m) = 20\log_{10}\left(\frac{pG_{Rf}(l, m)}{pG_{Rs}(l, m)}\right)$$

$$D_{CLD}^{modified}(2, l, m) = 10\log_{10}\left(\frac{pG_{Lf}^2(l, m) + pG_{Ls}^2(l, m)}{pG_{Rf}^2(l, m) + pG_{Rs}^2(l, m)}\right)$$

$$D_{CLD}^{modified}(3, l, m) = 20\log_{10}\left(\frac{pG_C(l, m)}{pG_{lfe}(l, m)}\right)$$

$$D_{CLD}^{modified}(4, l, m) = 10\log_{10}\left(\frac{pG_{Lf}^2(l, m) + pG_{Ls}^2(l, m) + pG_{Rf}^2(l, m) + pG_{Rs}^2(l, m)}{pG_C^2(l, m) + pG_{lfe}^2(l, m)}\right)$$

Hereinafter, a structure where CLD, CPC and ICC are used as spatial cues when the SAC decoder 203 is an MPEG Surround stereo mode, which is a so-called 525 mode. In the MPEG Surround stereo mode, a left signal L0 and a right signal R0 are received as input audio signals and a multi-channel signal is outputted as an output signal. The MPEG Surround stereo mode is disclosed in detail in International Standard MPEG Surround (WD N7136, 23003-1:2006/FDIS) published by the ISO/IEC JTC in February 2005. In the present invention, the MPEG Surround stereo mode is no more than an embodiment for describing the present invention. Thus, detailed description on it will not be provided, and the International Standard forms part of the present specification within the range that it helps understanding of the present invention.

When the SAC decoder 203 is an MPEG Surround stereo mode, the SAC decoder 203, diagonal matrix elements of a vector needed for the SAC decoder 203 to generate multi-channel signals from the input audio signals L0 and R0 are fixed as 0, as shown in Equation 18. This signifies that the R0 signal does not contribute to the generation of Lf and Ls signals and the L0 signal does not contribute to the generation of Rf and Rs signals in the MPEG Surround stereo mode. Therefore, it is impossible to perform rendering onto audio signals based on the control information for the rendering of an input audio signal.

$$R_1^{l,m} = \begin{bmatrix} w_{11}^{l,m} & 0 \\ 0 & w_{22}^{l,m} \\ w_{31}^{l,m}\sqrt{2} & w_{32}^{l,m}\sqrt{2} \\ w_{11}^{l,m} & 0 \\ 0 & w_{22}^{l,m} \end{bmatrix}, \quad \text{Equation 18}$$

where $w_{ij}^{l,m}$ is a coefficient generated from a power gain acquired from CLD (i and j are vector matrix indexes; m is a sub-band index; and l is a parameter set index).

CLD for the MPEG Surround stereo mode includes $CLD_{LR/Clfe}$, $CLD_{L/R}$, $CLD_{C/lfe}$, $CLD_{Lf/Ls}$ and $CLD_{Rf/Rs}$. The $CLD_{Lf/Ls}$ is a sub-band power ratio (dB) between a left rear channel signal (Ls) and a left front channel signal (Lf), whereas $CLD_{Rf/Rs}$ is a sub-band power ratio (dB) between a right rear channel signal (Rs) and a right front channel signal (Rf). The other CLD values are power ratios of a channel marked at their subscripts.

The SAC decoder 203 of the MPEG Surround stereo mode extracts a center signal (C), left half plane signals (Ls+Lf), and right half plane signals (Rf+Rs) from right and left signals (L0, R0) inputted based on the Equation 18. Each of the left half plane signals (Ls+Lf). The right half plane signals (Rf+Rs) and the left half plane signals (Ls+Lf) are used to generate right signal components (Rf, Rs) and left signal components (Ls, Lf), respectively.

It can be seen from the Equation 18 that the left half plane signals (Ls+Lf) is generated from the inputted left signal (L0). In short, right half plane signals (Rf+Rs) and the center signal (c) do not contribute to generation of the left signal components (Ls, Lf). The reverse is the same, too. (That is, the R0 signal does not contribute to generation of the Lf and Ls signals and, similarly, the L0 signal does not contribute to generation of the Rf and Rs signals.) This signifies that the panning angle is restricted to about ±30° for the rendering of audio signals.

According to an embodiment of the present invention, the above Equation 18 is modified as Equation 19 to flexibly control the rendering of multi-objects or multi-channel audio signals.

$$R_l'^{l,m} = \begin{bmatrix} w_{11}^{l,m} & w_{12}'^{l,m} \\ w_{21}'^{l,m} & w_{22}^{l,m} \\ w_{31}^{l,m}\sqrt{2} & w_{32}^{l,m}\sqrt{2} \\ w_{11}^{l,m} & w_{12}^{l,m} \\ w_{21}^{l,m} & w_{22}^{l,m} \end{bmatrix}, \quad \text{Equation 19}$$

$$0 \le m < m_{ttLowProc}(0),\ 0 \le l < L$$

where $m_{mLow\ Proc}$ denotes the number of sub-bands.

Differently from Equation 18, Equation 19 signifies that the right half plane signals (Rf+Rs) and the center signal (C) contribute to the generation of the left signal components (Ls, Lf), and vice versa (which means that the R0 signal contributes to the generation of the Lf and Ls signals and, likewise, the L0 signal contributes to the generation of the Rf and Rs signals. This means that the panning angle is not restricted for the rendering of an audio signal.

The spatial cue renderer 201 shown in FIGS. 2 and 4 outputs a controlled power gain (${}_{out}G_m$) or a converted CLD value ($CLD_m^i$) that is used to calculate a coefficient ($w_{ij}^{l,m}$) which forms the vector of the Equation 19 based on the power gain of an input audio signal and control information for rendering of the input audio signal (i.e., an interaction control signal inputted from the outside). The elements $w_{12}^{tl,m}$, $w_{21}^{tl,m}$, $w_{31}^{tl,m}$ and $w_{32}^{tl,m}$ are defined as the following Equation 20.

$$w_{12}'^{l,m} = \frac{P_{pan}^{L}}{\sqrt{P_C/2 + P_{Rf} + P_{Rs}}} \quad \text{Equation 20}$$

$$w_{21}'^{l,m} = \frac{P_{pan}^{R}}{\sqrt{P_C/2 + P_{Lf} + P_{Ls}}}$$

$$w_{13}'^{l,m} = \frac{P_{pan}^{CL}}{\sqrt{P_C/2 + P_{Rf} + P_{Rs}}}$$

$$w_{31}'^{l,m} = \frac{P_{pan}^{CR}}{\sqrt{P_C/2 + P_{Lf} + P_{Ls}}}$$

The functions of $w_{12}^{tl,m}$ and $w_{21}^{tl,m}$ are not extracting the center signal component (C) but projecting half plane signals onto the opposite half plane at the panning angle. The $w_{11}^{tl,m}$ and $w_{22}^{tl,m}$ are defined as the following Equation 21.

$$(w_{11}^{tl,m})^2+(w_{21}^{tl,m})^2+(w_{31}^{tl,m})^2=1$$

$$(w_{12}^{tl,m})^2+(w_{22}^{tl,m})^2+(w_{32}^{tl,m})^2=1 \quad \text{Equation 21}$$

where the power gains ($P_C$, $P_{Lf}$, $P_{Ls}$, $P_{Rf}$, $P_{Rs}$) are calculated based on the CLD values ($CLD_{LR/Clfe}$, $CLD_{L/R}$, $CLD_{C/lfe}$, $CLD_{Lf/Ls}$ and $CLD_{Rf/Rs}$) inputted from the CLD parsing unit 401 based on the Equation 2.

$P_{pan}^{L}$ is a projected power according to the Panning Law in proportion to a combination of $P_C$, $P_{Lf}$, $P_{Ls}$. Similarly, $P_{pan}^{R}$ is in proportion to a combination of $P_C$, $P_{Rf}$, $P_{Rs}$. The $P_{pan}^{CL}$ and $P_{pan}^{CR}$ are panning power gains for the central channel of the left half plane and the central channel of the right half plane, respectively.

Equations 19 to 21 aim at flexibly controlling the rendering of the left signal (L0) and the right signal (R0) of input audio signals according to the control information, which is an interaction control signal. The gain factor control unit 405 receives the control information, which is an interaction control signal for rendering of an input audio signal, for example, angle information $\theta_{pan}$=40°. Then, it adjusts the power gains ($P_C$, $P_{Lf}$, $P_{Ls}$, $P_{Rf}$, $P_{Rs}$) of each input audio signal outputted from the gain factor conversion unit 403, and calculates additional power gains ($P_{pan}^{L}$, $P_{pan}^{R}$, $P_{pan}^{CL}$ and $P_{pan}^{CR}$) as shown in the following Equation 22.

$$P_{pan}^{CR}=P_C/2+\alpha^2\cdot P_{Lf}=P_C/2+(\cos(\theta_m))^2\cdot P_{Lf}$$

$$P_{pan}^{R}=\beta^2\cdot P_{Lf}=(\sin(\theta_m))^2\cdot P_{Lf}$$

$$P_{pan}^{CL}=P_C/2$$

$$P_{pan}^{L}=0 \quad \text{Equation 22}$$

where $\alpha=\cos(\theta_{pan})$, $\beta=\sin(\theta_{pan})$; and $\theta_m$ is as defined in Equation 15.

The acquired power gains ($P_C$, $P_{Lf}$, $P_{Ls}$, $P_{Rf}$, $P_{Rs}$, $P_{pan}^{L}$, $P_{pan}^{R}$, $P_{pan}^{CL}$ and $P_{pan}^{CR}$) and are outputted as controlled power gains, which are presented in the following Equation 23.

$$_{out}g_m^{Lf}=0$$

$$_{out}g_m^{Ls}=\sqrt{P_{Ls}}$$

$$_{out}g_m^{Rf}=\sqrt{P_{Rf}+P_{pan}^{R}}$$

$$_{out}g_m^{Rs}=\sqrt{P_{Rs}}$$

$$_{out}g_m^{CL}=\sqrt{P_C/2=P_{pan}^{CL}}$$

$$_{out}g_m^{CR}=\sqrt{P_{pan}^{CR}} \quad \text{Equation 23}$$

Herein, the center signal (C) is calculated separately for CL and CR because the center signal should be calculated both from L0 and R0. In the MPEG Surround stereo mode, the gain factor control unit 405 outputs the controlled power gains of Equation 23, and the SAC decoder 203 performs rendering onto the input audio signals based on the control information on the rendering of the input audio signals, i.e., an interaction control signal, by applying the controlled power gains to the input audio signals L0 and R0 inputted based on the vector of the Equation 19.

Herein, the L0 and R0 should be pre-mixed or pre-processed to obtain the vector of the Equation 19 based on the matrix elements expressed as Equation 20 to control the rendering of the input audio signals L0 and R0 based on the vector of the Equation 19 in the SAC decoder 203. The pre-mixing or pre-processing makes it possible to control rendering of controlled power gains ($_{out}G_m$) or converted CLD value ($CLD_m^i$).

Figure 7:
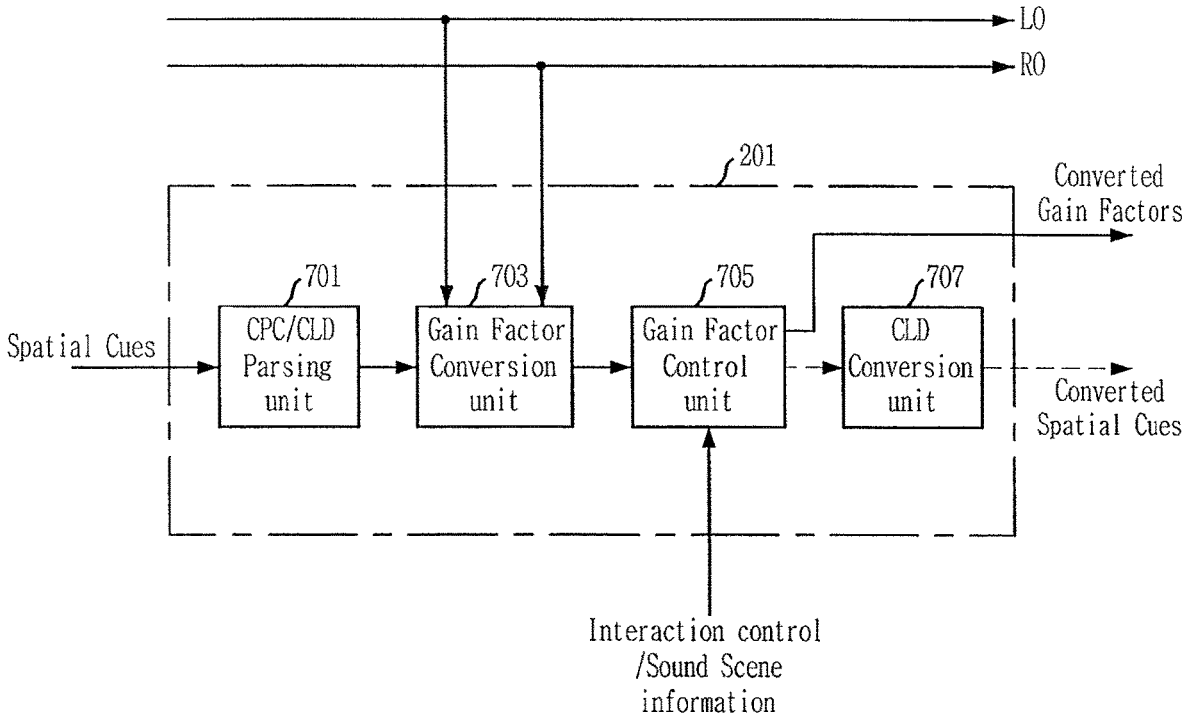
FIG. 7 is a detailed block diagram describing a spatial cue renderer in accordance with an embodiment of the present invention when an SAC decoder is in an MPEG Surround stereo mode.

FIG. 7 is a detailed block diagram describing a spatial cue renderer 201 in accordance with an embodiment of the present invention, when the SAC decoder 203 is in the MPEG Surround stereo mode. As shown, the spatial cue renderer 201 using CLD or CPC as a spatial cue includes a CPC/CLD parsing unit 701, a gain factor conversion unit 703, a gain factor control unit 705, and a CLD conversion unit 707.

When the SAC decoder 203 uses CPC and CLD as spatial cues in the MPEG Surround stereo mode, the CPC makes a prediction based on some proper standards in an encoder to secure the quality of down-mixed signals and output signals for play. In consequences, CPC denotes a compressive gain ratio, and it is transferred to an audio signal rendering apparatus suggested in the embodiment of the present invention.

After all, lack of information on standard hinders accurate analysis on the CPC parameter in the spatial cue renderer 201. In other words, even if the spatial cue renderer 201 can control the power gains of audio signals, once the power gains of the audio signals are changed (which means 'controlled') according to control information (i.e., an interaction control signal) on rendering of the audio signals, no CPC value is calculated from the controlled power gains of the audio signals.

According to the embodiment of the present invention, the center signal (C), left half plane signals (Ls+Lf), and right half plane signals (Rs+Rf) are extracted from the input audio signals L0 and R0 through the CPC. The other audio signals, which include left signal components (Ls, Lf) and right signal components (Rf, Rs), are extracted through the CLD. The power gains of the extracted audio signals are calculated. Sound scenes are controlled not by directly manipulating the audio output signals but by controlling the spatial cue parameter so that the acquired power gains are changed (i.e., controlled) according to the control information on the rendering of the audio signals.

First, the CPC/CLD parsing unit 701 extracts a CPC parameter and a CLD parameter from received spatial cues (which are CPC and CLD). The gain factor conversion unit 703 extracts the center signal (C), left half plane signals (Ls+Lf) and right half plane signals (Rf+Rs) from the CPC parameter extracted in the CPC/CLD parsing unit 701 based on the following Equation 24.

$$M_{PDC}\begin{bmatrix} l_0 \\ r_0 \end{bmatrix} = \begin{bmatrix} l \\ r \\ c \end{bmatrix} \quad \text{Equation 24}$$

$$M_{PDC} = \begin{bmatrix} c_{11} & c_{12} \\ c_{21} & c_{22} \\ c_{31} & c_{32} \end{bmatrix}$$

where $l_0$,$r_0$,l,r,c denote input the audio signals L0 and R0, the left half plane signal (Ls+Lf), the right half plane signal (Rf+Rs), and the center signal (C), respectively; and $M_{PDC}$ denotes a CPC coefficient vector.

The gain factor conversion unit 703 calculates the power gains of the center signal (C), the left half plane signal (Ls+Lf), and the right half plane signal (Rf+Rs), and it also calculates power gains of the other audio signals, which include the left signal components (Ls, Lf) and the right signal components (Rf, Rs), individually, from the CLD parameter ($CLD_{Lf/Ls}$,$CLD_{Rf/Rs}$) extracted in the CPC/CLD parsing unit 701, such as Equation 2. Accordingly, the power gains of the sub-bands are all acquired.

Subsequently, the gain factor control unit 705 receives the control information (i.e., an interaction control signal) on the rendering of the input audio signals, controls the power gains of the sub-bands acquired in the gain factor conversion unit 703 and calculates controlled power gains which are shown in the Equation 4.

The controlled power gains are applied to the input audio signals L0 and R0 through the vector of the Equation 19 in the SAC decoder 203 to thereby perform rendering according to the control information (i.e., an interaction control signal) on the rendering of the input audio signals.

Meanwhile, when the SAC decoder 203 is in the MPEG Surround stereo mode and it uses ICC as a spatial cue, the spatial cue renderer 201 corrects the ICC parameter through a linear interpolation process as shown in the following Equation 25.

$$ICC_{Ls,Lf} = (1-\eta)ICC_{Ls,Lf} + \eta ICC_{Rs,Rf} \quad \text{Equation 25}$$

$$ICC_{Rs,Rf} = (1-\eta)ICC_{Rs,Rf} + \eta ICC_{Ls,Lf}$$

$$\eta = \frac{\theta_{pan}}{\pi}, \theta_{pan} \le \pi$$

$$\eta = 1 - \frac{\theta_{pan} - \pi}{\pi}, \theta_{pan} > \pi$$

where $\theta_{pan}$ denotes angle information inputted as the control information (i.e., an interaction control signal) on the rendering of the input audio signal.

In short, the left and right ICC values are linearly interpolated according to the rotation angle ($\theta_{pan}$).

Meanwhile, a conventional SAC decoder receives a spatial cue, e.g., CLD, converts it into a power gain, and decodes an input audio signal based on the power gain.

Herein, the CLD inputted to the conventional SAC decoder corresponds to the converted signal value ($CLD_m^i$) of the CLD conversion unit 407 in the embodiment of the present invention. The power gain controlled by the conventional SAC decoder corresponds to the power gain ($_{out}G_m$) of the gain factor control unit 405 in the embodiment of the present invention.

According to another embodiment of the present invention, the SAC decoder 203 may use the power gain ($_{out}G_m$) acquired in the gain factor control unit 405 as a spatial cue, instead of using the converted signal value ($CLD_m^i$) acquired in the CLD conversion unit 407. Hence, the process of converting the spatial cue, i.e., $CLD_m^i$, into a power gain ($_{out}G_m$) in the SAC decoder 203 may be omitted. In this case, since the SAC decoder 203 does not need the converted signal value ($CLD_m^i$) acquired in the CLD conversion unit 407, the spatial cue renderer 201 may be designed not to include the CLD conversion unit 407.

Meanwhile, the functions of the blocks illustrated in the drawings of the present specification may be integrated into one unit. For example, the spatial cue renderer 201 may be formed to be included in the SAC decoder 203. Such integration among the constituent elements belongs to the scope and range of the present invention. Although the blocks illustrated separately in the drawings, it does mean that each block should be formed as a separate unit.

Figure 8:
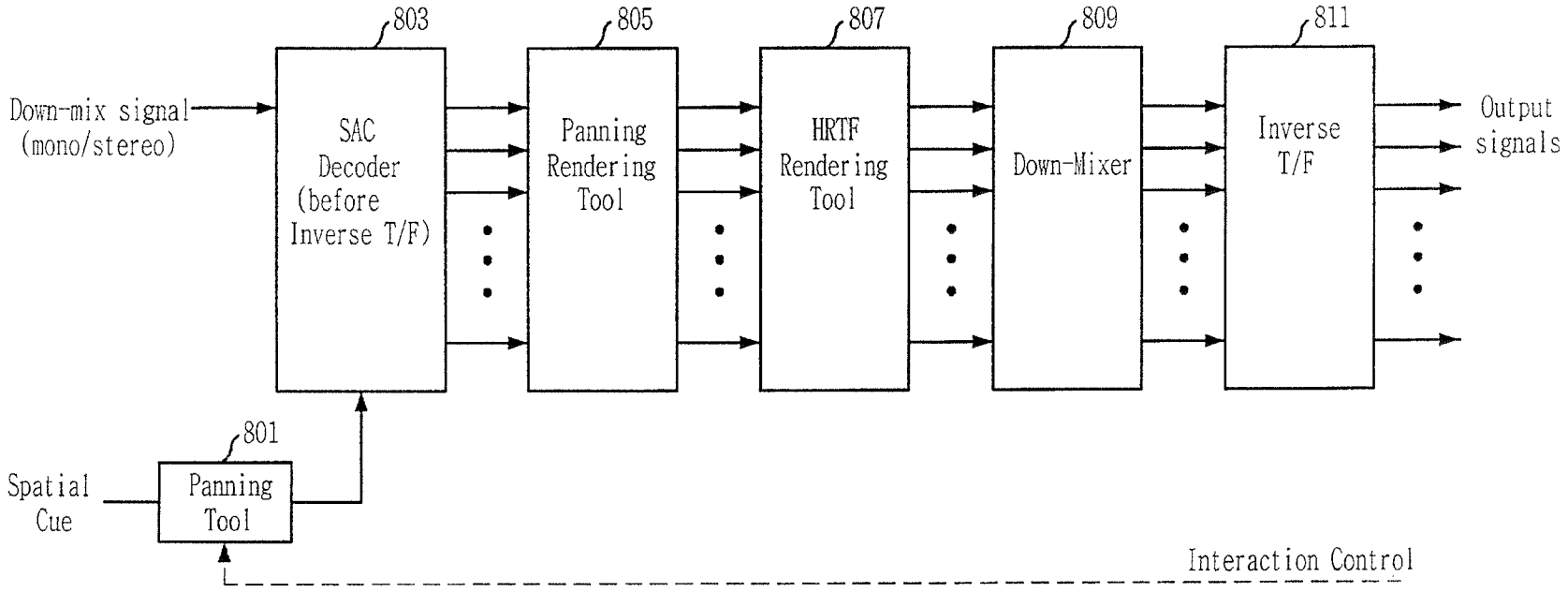
FIG. 8 illustrates a spatial decoder for decoding multi-object or multi-channel audio signals.
Figure 9:
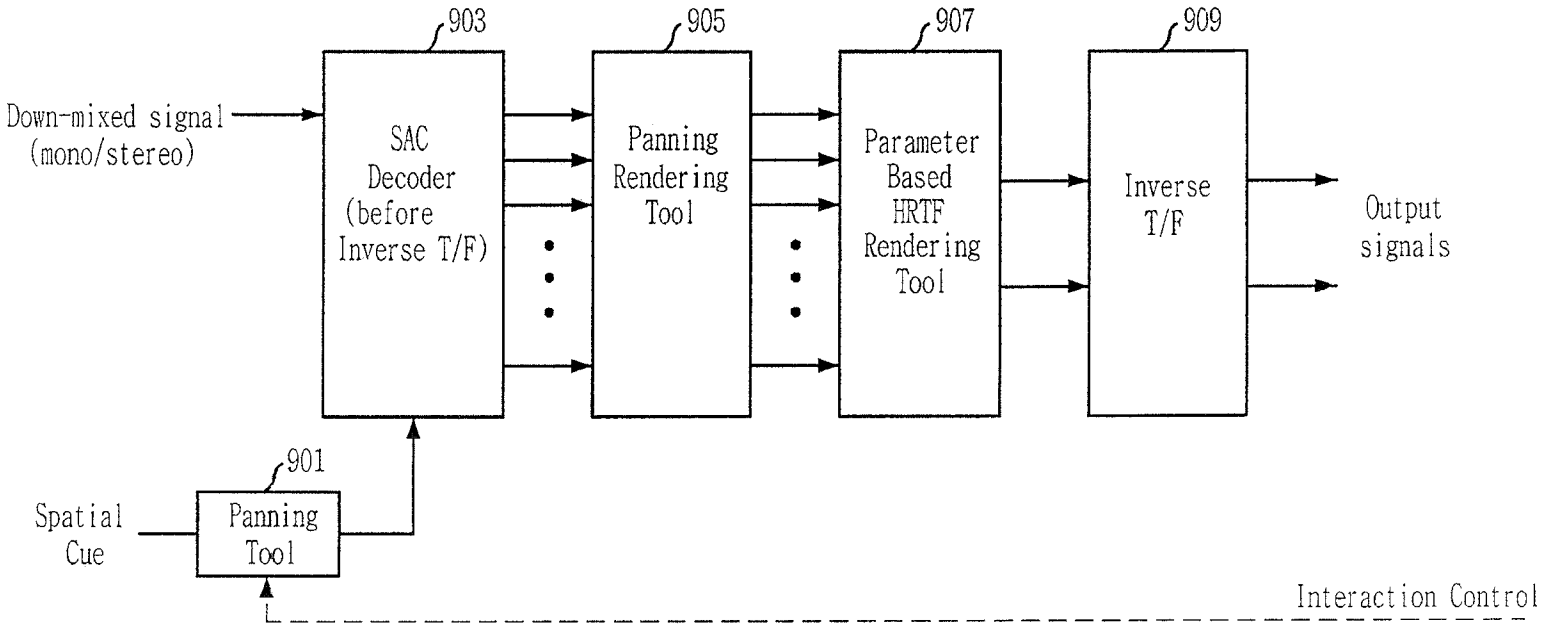
FIG. 9 illustrates a three-dimensional (3D) stereo audio signal decoder, which is a spatial decoder.

FIGS. 8 and 9 present an embodiment of the present invention to which the audio signal rendering controller of FIG. 2 can be applied. FIG. 8 illustrates a spatial decoder for decoding multi-object or multi-channel audio signals. FIG. 9 illustrates a three-dimensional (3D) stereo audio signal decoder, which is a spatial decoder.

SAC decoders 803 and 903 of FIGS. 8 and 9 may adopt an audio decoding method using a spatial cue, such as MPEG Surround, Binaural Cue Coding (BCC), and Sound Source Location Cue Coding (SSLCC). The panning tools 901 and 901 of FIGS. 8 and 9 correspond to the spatial cue renderer 201 of FIG. 2.

Figure 10:
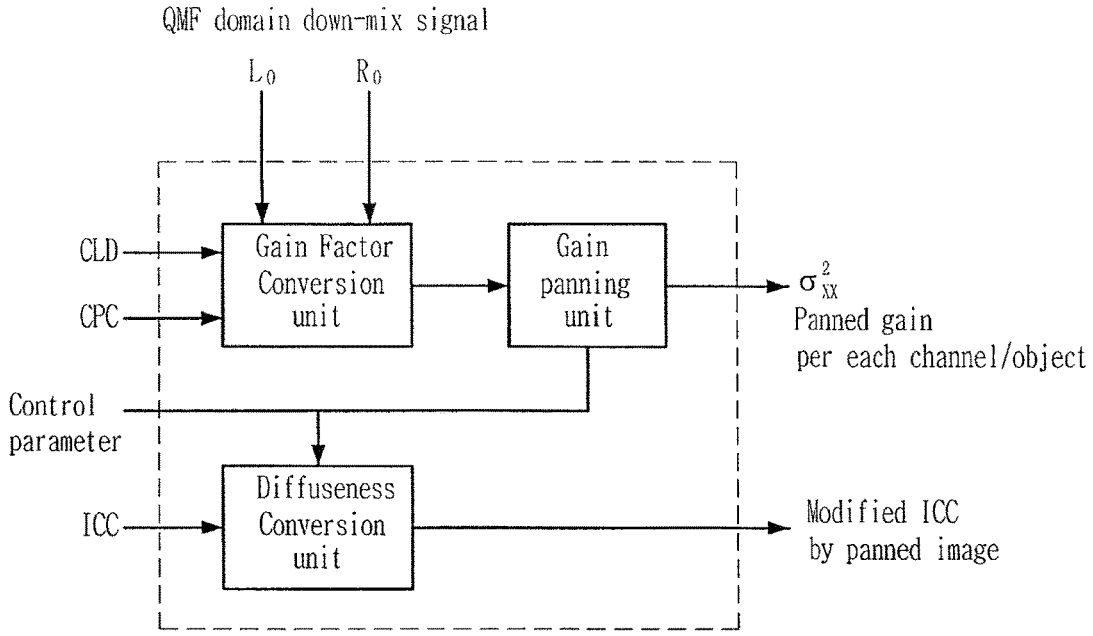
FIG. 10 is a view showing an embodiment of a spatial cue renderer to be applied to FIGS. 8 and 9.

FIG. 10 is a view showing an example of the spatial cue renderer 201 of FIG. 2 that can be applied to FIGS. 8 and 9.

FIG. 10 corresponds to the spatial cue renderer of FIG. 4. The spatial cue renderer shown in FIG. 10 is designed to process other spatial cues such as CPC and ICC, and the spatial cue renderer of FIG. 4 processes only CLD. Herein, the parsing unit and the CLD conversion unit are omitted for the sake of convenience, and the control information (i.e., an interaction control signal) on the rendering of input audio signals and the gain factor control unit are presented as a control parameter and a gain panning unit, respectively. The output ($\sigma_{xx}^2$) of the gain factor control unit signifies a controlled power gain, and it may be inputted to the spatial cue renderer 201. As described above, the present invention can control the rendering of input audio signals based on a spatial cue, e.g., CLD, inputted to the decoder. An embodiment thereof is shown in FIG. 10.

According to the embodiment of the spatial cue renderer illustrated in FIG. 10, the level of a multi-object or multi-channel audio signal may be eliminated (which is referred to as suppression). For example, when CLD is information on a power level ratio of a $j^{th}$ input audio signal and a $k^{th}$ input audio signal in an $m^{th}$ sub-band, the power gain ($g_m^j$) of the $j^{th}$ input audio signal and the power gain ($g_m^k$) of the $k^{th}$ input audio signal are calculated based on the Equation 2.

Herein, when the power level of the $k^{th}$ input audio signal is to be eliminated, only the power gain ($g_m^k$) element of the $k^{th}$ input audio signal is adjusted as 0.

Back to FIGS. 8 and 9, according to the embodiment of the present invention, the multi-object or multi-channel audio signal is rendered according to the Panning method based on the rendering information of the controlled input audio signal, which is inputted to the panning rendering tools 805 and 905 and controlled in the spatial cue domain by the panning tools 801 and 901. Herein, since the input audio signal inputted to the panning rendering tools 805 and 905 is processed in the frequency domain (a complex number domain), the rendering may be performed on a sub-band basis, too.

A signal outputted from the panning rendering tools 805 and 905 may be rendered in an HRTF method in HRTF rendering tools 807 and 907. The HRTF rendering is a method applying an HRTF filter to each object or each channel.

The rendering process may be optionally carried out by using the panning method of the panning rendering tools 805 and 905 and the HRTF method of the HRTF rendering tools 807 and 907. That is, the panning rendering tools 805 and 905 and the HRTF rendering tools 807 and 907 are the options. However, when all the panning rendering tools 805 and 905 and the HRTF rendering tools 807 and 907 are selected, the panning rendering tools 805 and 905 are executed prior to the HRTF rendering tools 807 and 907.

As described above, the panning rendering tools 805 and 905 and the HRTF rendering tools 807 and 907 may not use the converted signal ($CLD_m^i$) acquired in the CLD conversion unit 407 of the panning tools 801 and 901, but use the power gain ($_{out}G_m$) acquired in the gain factor control unit 405. In this case, the HRTF rendering tools 807 and 907 may adjust the HRTF coefficient by using power level of the input audio signals of each object or each channel. Herein, the panning tools 801 and 901 may be designed not to include the CLD conversion unit 407.

A down-mixer 809 performs down-mixing such that the number of the output audio signals is smaller than the number of decoded multi-object or multi-channel audio signals.

An inverse T/F 811 converts the rendered multi-object or multi-channel audio signals of a frequency domain into a time domain by performing inverse T/F conversion.

The spatial cue-based decoder illustrated in FIG. 9, e.g., the 3D stereo audio signal decoder, also includes the panning rendering tool 905 and the HRTF rendering tool 907. The HRTF rendering tool 907 follows the binaural decoding method of the MPEG Surround to output stereo signals. In short, a parameter-based HRTF filtering is applied.

Since the panning rendering tools 805 and 905 and the HRTF rendering tools 807 and 907 are widely known, detailed description on them will not be provided herein.

The binaural decoding method is a method of receiving input audio signals and outputting binaural stereo signals, which are 3D stereo signals. Generally, the HRTF filtering is used.

The present invention can be applied to a case where binaural stereo signals, which are 3D stereo signals, are played through the SAC multi-channel decoder. Generally, binaural stereo signals corresponding to a 5.1 channel are created based on the following Equation 26.

$$x_{Binaural_L}(t)=x_{Lf}(t)*h_{-30,L}(t)+x_{Rf_L}(t)*h_{30,L}(t)+x_{Ls_L}(t)*h_{-110,L}(t)+x_{Rs_L}(t)*h_{110,L}(t)+x_{C_L}(t)*h_{0,L}(t)$$

$$x_{Binaural_R}(t)=x_{Lf}(t)*h_{-30,R}(t)+x_{Rf_L}(t)*h_{30,R}(t)+x_{Ls_L}(t)*h_{-110,R}(t)+x_{Rs_L}(t)*h_{110,R}(t)+x_{C_L}(t)*h_{0,R}(t) \quad \text{Equation 26}$$

where x denotes an input audio signal; h denotes an HRTF function; and $x_{Binaural}$ denotes an output audio signal, which is a binaural stereo signal (3D stereo signal).

To sum up, an HRTF function goes through complex integral for each input audio signal to thereby be down-mixed and produce a binaural stereo signal.

According to conventional methods, the HRTF function applied to each input audio signal should be converted into a function of a control position and then used to perform rendering onto a binaural stereo signal according to the control information (e.g., interaction control signal) on the rendering of an input audio signal. For example, when the control information (e.g., interaction control signal) on the rendering of an input audio signal for the virtual position of Lf is 40°, the Equation 26 is converted into the following Equation 27.

$$x_{Binaural_L}(t)=x_{Lf}(t)*h_{40,L}(t)+x_{Rf_L}(t)*h_{30,L}(t)+x_{Ls_L}(t)*h_{-110,L}(t)+x_{Rs_L}(t)*h_{110,L}(t)+x_{C_L}(t)*h_{0,L}(t)$$

$$x_{Binaural_R}(t)=x_{Lf}(t)*h_{40,R}(t)+x_{Rf_L}(t)*h_{30,R}(t)+x_{Ls_L}(t)*h_{-110,R}(t)+x_{Rs_L}(t)*h_{110,R}(t)+x_{C_L}(t)*h_{0,R}(t) \quad \text{Equation 27}$$

According to an embodiment of the present invention, however, a sound scene is controlled for an output audio signal by adjusting a spatial cue parameter based on the control information (e.g., an interaction control signal) on the rendering of an input audio signal, instead of controlling the HRTF function differently from the Equation 27 in a process of controlling rendering of a binaural stereo signal. Then, the binaural signal is rendered by applying only a predetermined HRTF function of the Equation 26.

When the spatial cue renderer 201 controls the rendering of a binaural signal based on the controlled spatial cue in the spatial cue domain, the Equation 26 can be always applied without controlling the HRTF function such as the Equation 27.

After all, the rendering of the output audio signal is controlled in the spatial cue domain according to the control information (e.g., an interaction control signal) on the rendering of an input audio signal in the spatial cue renderer 201. The HRTF function can be applied without a change.

According to an embodiment of the present invention, rendering of a binaural stereo signal is controlled with a limited number of HRTF functions. According to a conventional binaural decoding method, HRTF functions are needed as many as possible to control the rendering of a binaural stereo signal.

Figure 11:
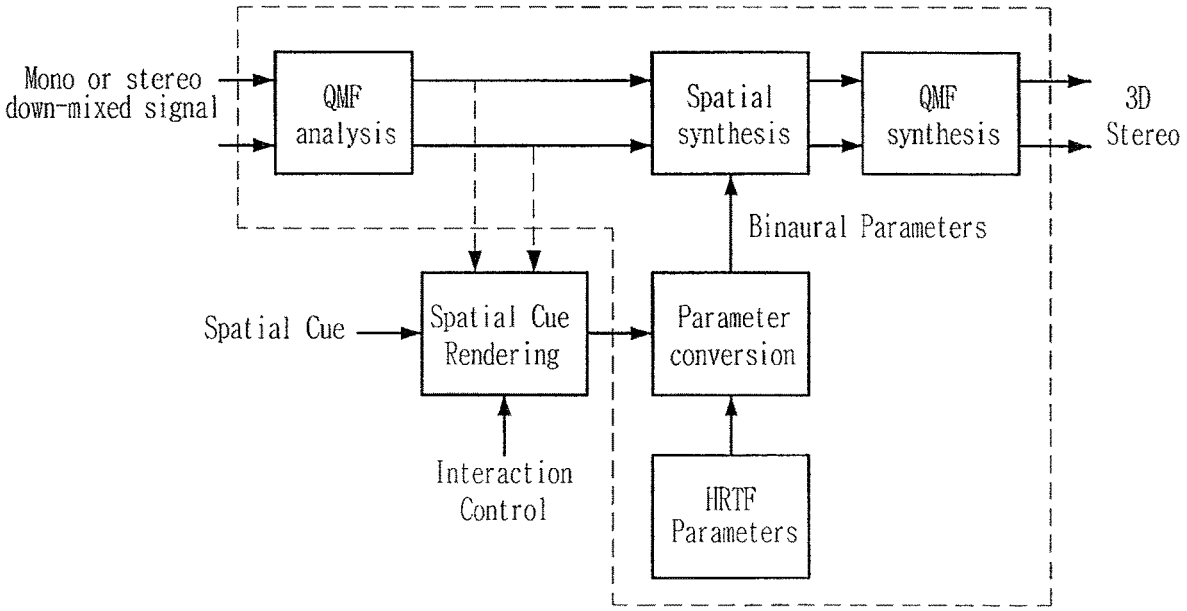
FIG. 11 is a view illustrating a Moving Picture Experts Group (MPEG) Surround decoder adopting a binaural stereo decoding.

FIG. 11 is a view illustrating a Moving Picture Experts Group (MPEG) Surround decoder adopting a binoral stereo decoding. It shows a structure that is conceptually the same as that of FIG. 9. Herein, the spatial cue rendering block is a spatial cue renderer 201 and it outputs a controlled power gain. The other constituent elements are conceptually the same as those of FIG. 9, too, and they show a structure of an MPEG Surround decoder adopting a binaural stereo decoding. The output of the spatial cue rendering block is used to control the frequency response characteristic of the HRTF functions in the parameter conversion block of the MPEG Surround decoder.

Figure 12:
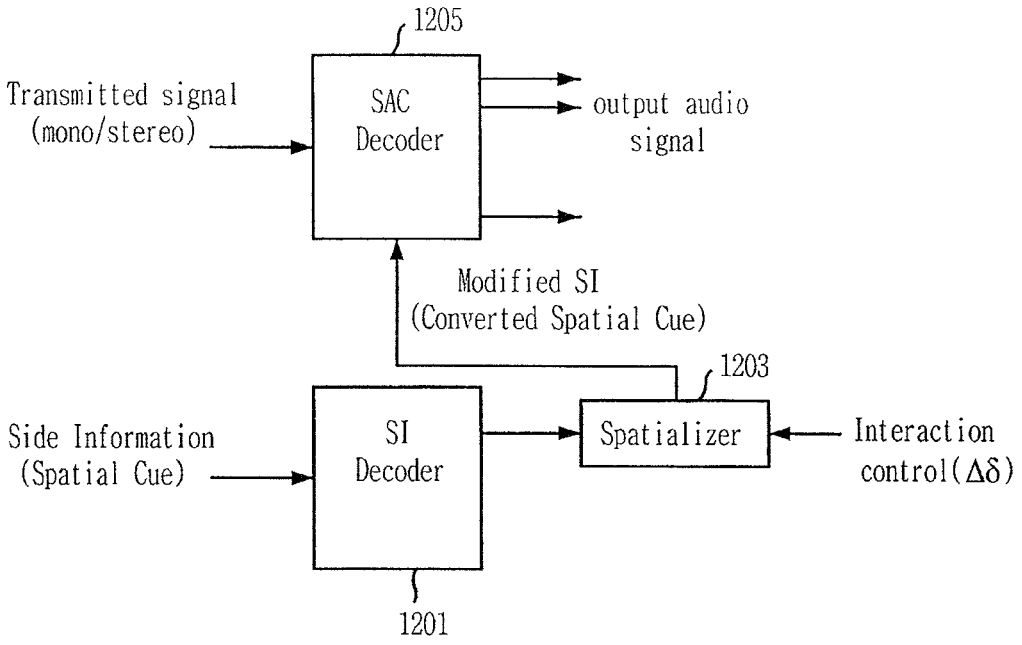
FIG. 12 is a view describing an audio signal rendering controller in accordance with another embodiment of the present invention.
Figure 13:
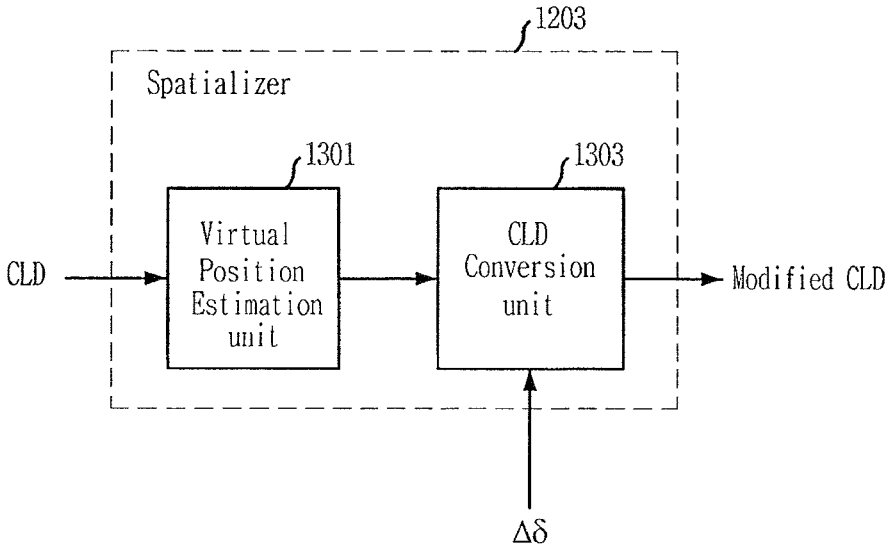
FIG. 13 is a detailed block diagram illustrating a spatializer of FIG. 12.
Figure 14:
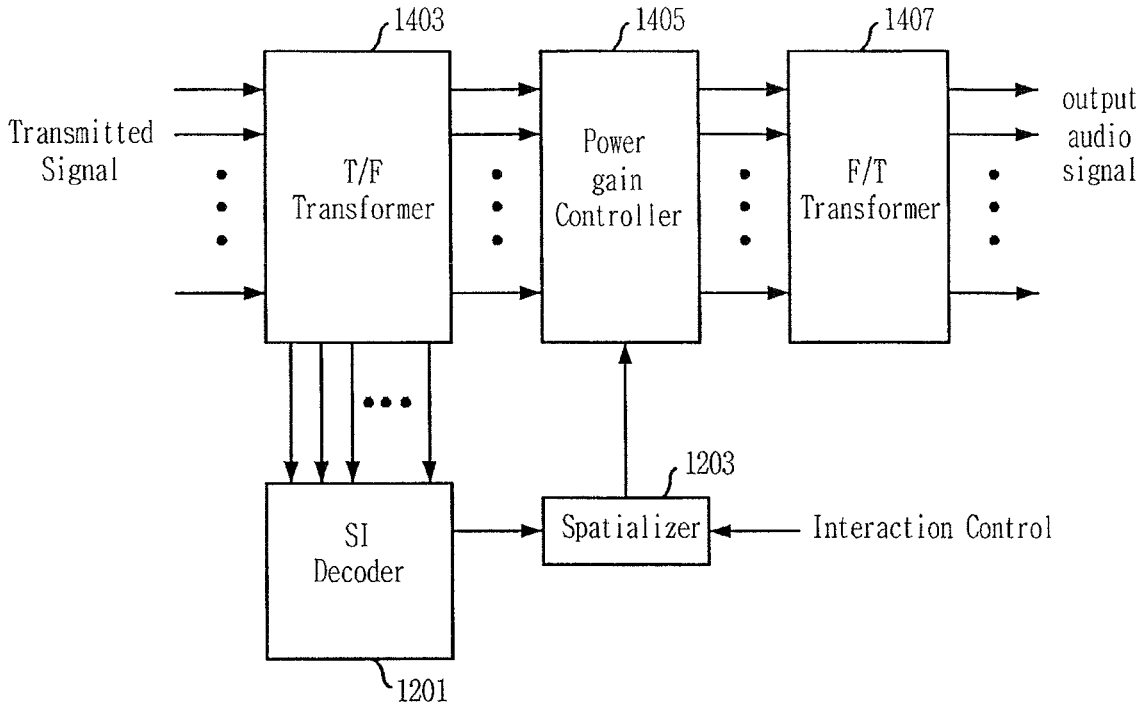
FIG. 14 is a view describing a multi-channel audio decoder to which the embodiment of the present invention is applied.

FIGS. 12 to 14 present another embodiment of the present invention. FIG. 12 is a view describing an audio signal rendering controller in accordance with another embodiment of the present invention. According to the embodiment of the present invention, multi-channel audio signals can be efficiently controlled by adjusting a spatial cue, and this can be usefully applied to an interactive 3D audio/video service.

As shown in the drawings, the audio signal rendering controller suggested in the embodiment of the present invention includes an SAC decoder 1205, which corresponds to the SAC encoder 101 of FIG. 1, and it further includes a side information (SI) decoder 1201 and a spatializer 1203.

The side information decoder 1201 and the spatializer 1203 correspond to the spatial cue renderer 201 of FIG. 2. Particularly, the side information decoder 1201 corresponds to the CLD parsing unit 401 of FIG. 4.

The side information decoder 1201 receives a spatial cue, e.g., CLD, and extracts a CLD parameter based on the Equation 1. The extracted CLD parameter is inputted to the spatializer 1203.

FIG. 13 is a detailed block diagram illustrating a spatializer of FIG. 12. As shown in the drawing, the spatializer 1203 includes a virtual position estimation unit 1301 and a CLD conversion unit 1303.

The virtual position estimation unit 1301 and the CLD conversion unit 1303 functionally correspond to the gain factor conversion unit 403, the gain factor control unit 405, and the CLD conversion unit 407 of FIG. 4.

The virtual position estimation unit 1301 calculates a power gain of each audio signal based on the inputted CLD parameter. The power gain can be calculated in diverse methods according to a CLD calculation method. For example, when all CLD of an input audio signal is calculated based on a reference audio signal, the power gain of each input audio signal can be calculated as the following Equation 28.

$$G_{i,b} = \frac{1}{\sqrt{1+\sum_{i=1}^{C-1} 10^{CLD_{i,b}/10}}} \quad \text{Equation 28}$$

$$G_{i+1,b} = 10^{CLD_{i+1,b}/10} G_{i,b}$$

where C denotes the number of the entire audio signals;

i denotes an audio signal index ($1 \le i \le C-1$);

b denotes a sub-band index; and $G_{i,b}$ denotes a power gain of an input audio signal (which includes a left front channel signal Lf, a left rear channel signal Ls, a right front channel signal Rf, a right rear channel signal Rs, and a center signal C).

Generally, the number of sub-bands is between 20 and 40 per frame. When the power gain of each audio signal is calculated for each sub-band, the virtual position estimation unit 1301 estimates the position of a virtual sound source from the power gain.

For example, when the input audio signals are of five channels, the spatial vector (which is the position of the virtual sound source) may be estimated as the following Equation 29.

$$Gv_b=A_1\times G_{1,b}+A_2\times G_{2,b}+A_3\times G_{3,b}+A_4\times G_{4,b}+A_5\times G_{5,b}$$

$$LHv_b=A_1\times G_{1,b}+A_2\times G_{2,b}+A_4\times G_{4,b}$$

$$RHv_b=A_1\times G_{1,b}+A_3\times G_{3,b}+A_5\times G_{5,b}$$

$$Lsv_b=A_1\times G_{1,b}+A_2\times G_{2,b}$$

$$Rsv_b=A_1\times G_{1,b}+A_3\times G_{3,b} \quad \text{Equation 29}$$

where i denotes an audio signal index; b denotes a sub-band index;

$A_i$ denotes the position of an output audio signal, which is a coordinate represented in a complex plane;

$Gv_b$ denotes an all-directional vector considering five input audio signals Lf, Ls, Rf, Rs, and C;

$LHv_b$ denotes a left half plane vector considering the audio signals Lf, Ls and C on a left half plane;

$RHv_b$ denotes a right half plane vector considering the audio signals Rf, Rs and C on a right half plane;

$Lsv_b$ denotes a left front vector considering only two input audio signals Lf and C; and $Rsv_b$ denotes a right front vector considering only two input audio signals Rf and C.

Herein, $Gv_b$ is controlled to control the position of a virtual sound source. When the position of a virtual sound source is to be controlled by using two vectors, $LHv_b$ and $RHv_b$ are utilized. The position of the virtual sound source is to be controlled with vectors for two pairs of input audio signals (i.e., a left front vector and a right front vector) such vectors as $Lsv_b$ and $Rsv_b$ may be used. When a vector is acquired and utilized for two pairs of input audio signals, there may be audio signal pairs as many as the number of input audio signals.

Information on the angle (i.e., panning angle of a virtual sound source) of each vector is calculated based on the following Equation 30.

$$Ga_b = \angle(Gv_b) = \arctan\frac{\mathrm{Im}(Gv_b)}{Re(Gv_b)} \quad \text{Equation 30}$$

Similarly, angle information ($LHa_b$, $RHa_b$, $Lsa_b$ and $Rsa_b$) of the rest vectors may be acquired similarly to the Equation 20.

The panning angle of a virtual sound source can be freely estimated among desired audio signals, and the Equations 29 and 30 are no more than mere part of diverse calculation methods. Therefore, the present invention is not limited to the use of Equations 29 and 30.

The power gain ($M_{downmix,b}$) of a $b^{th}$ sub-band of a down-mixed signal is calculated based on the following Equation 31.

$$M_{downmix,b} = \sqrt{\sum_{n=B_b}^{B_{b+1}-1} |S_{downmix}(n)|} \quad \text{Equation 31}$$

where b denotes an index of a sub-band;

$B_b$ denotes a boundary of a sub-band;

S denotes a down-mixed signal; and n denotes an index of a frequency coefficient.

The spatializer 1203 is a constituent element that can flexibly control the position of a virtual sound source generated in the multiple channels. As described above, the virtual position estimation unit 1301 estimates a position vector of a virtual sound source based on the CLD parameter. The CLD conversion unit 1303 receives a position vector of the virtual sound source estimated in the virtual position estimation unit 1301 and a delta amount (Δδ) of the virtual sound source as rendering information, and calculates a position vector of a controlled virtual sound source based on the following Equation 32.

$$\overline{Ga_b} = Ga_b + \Delta\delta$$

$$\overline{LHa_b} = LHa_b + \Delta\delta$$

$$\overline{RHa_b} = RHa_b + \Delta\delta$$

$$\overline{Rsa_b} = Rsa_b + \Delta\delta$$

$$\overline{Lsa_b} = Lsa_b + \Delta\delta$$

The CLD conversion unit 1303 calculates controlled power gains of audio signals by reversely applying the Equations 29 and 31 to the position vectors ($\overline{Ga_b}$, $\overline{LHa_b}$, $\overline{RHa_b}$, $\overline{Rsa_b}$, and $\overline{Lsa_b}$) of the controlled virtual sound sources calculated based on the Equation 23. For example, an equation on $\overline{Ga_b}$ of the Equation 32 is applied for control with only one angle, and equations on $\overline{LHa_b}$ and $\overline{RHa_b}$ of the Equation 32 are applied for control with angles of two left half plane vector and a right half plane vector. Equations $\overline{Rsa_b}$ and $\overline{Lsa_b}$ of the Equation 32 are applied for control at an angle of a vector for two pairs of input audio signals (which include a left front audio signal and a right front audio signal). Equations on $Lsv_b$ and $Rsv_b$ are of the Equation 29 and equations $\overline{Rsa_b}$ and $\overline{Lsa_b}$ of the Equation 32 are similarly applied for control with an angle of a vector for the other pairs of input audio signals such as Ls and Lf, or Rs and Rf.

Also, the CLD conversion unit 1303 converts the controlled power gain into a CLD value.

The acquired CLD value is inputted into the SAC decoder 1205. The embodiment of the present invention can be applied to general multi-channel audio signals. FIG. 14 is a view describing a multi-channel audio decoder to which an embodiment of the present invention is applied. Referring to the drawing, it further includes a side information decoder 1201 and a spatializer 1203.

Multi-channel signals of the time domain are converted into signals of the frequency domain in a transformer 1403, such as a Discrete Fourier Transform (DFT) unit or a Quadrature Mirror Filterbank Transform (QMFT).

The side information decoder 1201 extracts spatial cues, e.g., CLD, from converted signals obtained in the transformer 1403 and transmits the spatial cues to the spatializer 1203. The spatializer 1203 transmits the CLD indicating a controlled power gain calculated based on the position vector of a controlled virtual sound source, which is the CLD acquired based on the Equation 32, to the power gain controller 1405. The power gain controller 1405 controls the power of each audio channel for each sub-band in the frequency domain based on the received CLD. The controlling is as shown in the following Equation 33.

$$S'_{ch,n} = S_{ch,n} \times G_{i,b}^{modified\ CLD},\ B_n \le n \le B_{n+1}-1$$

where $S_{ch,n}$ denotes an nth frequency coefficient of a $ch^{th}$ channel;

$S'_{ch,n}$ denotes a frequency coefficient deformed in the power gain control unit 1105;

$B_n$ denotes a boundary information of a $b^{th}$ sub-band; and $G_{i,b}^{modified\ CLD}$ denotes a gain coefficient calculated from a CLD value, which is an output signal of the spatializer 1203, i.e., a CLD value reflecting the Equation 32.

According to the embodiment of the present invention, the position of a virtual sound source of audio signals may be controlled by reflecting a delta amount of a spatial cue to the generation of multi-channel signals.

Although the above description has been made in the respect of an apparatus, it is obvious to those skilled in the art to which the present invention pertains that the present invention can also be realized in the respect of a method.

The method of the present invention described above may be realized as a program and stored in a computer-readable recording medium such as CD-ROM, RAM, ROM, floppy disks, hard disks, and magneto-optical disks.

While the present invention has been described with respect to certain preferred embodiments, it will be apparent to those skilled in the art that various changes and modifications may be made without departing from the scope of the invention as defined in the following claims.

INDUSTRIAL APPLICABILITY

The present invention is applied to decoding of multi-object or multi-channel audio signals.

The invention claimed is:

1. A method for processing of audio signals comprising:

identifying information including a level of input audio signals, number of input audio signals, and number of output audio signals for generating the number of output audio signals from the number of input audio signals; and outputting the number of output audio signals by applying a gain for each channels of the number of input audio signals into the level of input audio signals based on audio scene information, wherein the audio scene information is related to reproduction environment of the number of output audio signals, wherein the audio scene information includes an output position or an output level for the number of input audio signals.

2. The method of claim 1, wherein channel of the number of output audio signals includes Center(C) Channel, Low Frequency Effect(Lfe) Channel, Left Front(Lf) Channel, Right Front(Rf) Channel, Right Surround(Rs) Channel and, Left Surround(Ls) Channel.

3. A method for processing of audio signals comprising:

extracting (i) a level of input audio signals, (ii) number of channels for input audio signals, and (iii) number of channels for output audio signals from a bitstream;

determining gain for the number of channels of the number of input audio signals; and rendering N channels of the number of input audio signals into M channels of the number of output audio signals by adjusting level for each N channels of the number of input audio signals based on the gain; and generating the number of output audio signals based on a result of the rendering for the number of input audio signals, wherein the gain is applied into the level of the number of input audio signals based on audio scene information for rendering, wherein the audio scene information is related to reproduction environment of the number of output audio signals, wherein the audio scene information includes output position or output level for the number of input audio signals.

4. The method of claim 3, wherein the channel of the number of output audio signals includes Center(C) Channel, Low Frequency Effect(Lfe) Channel, Left Front(Lf) Channel, Right Front(Rf) Channel, Right Surround(Rs) Channel and, Left Surround(Ls) Channel.

5. The method of claim 3, wherein the Center(C) Channel, Low Frequency Effect(Lfe) Channel, Left Front(Lf) Channel, Right Front(Rf) Channel, Right Surround(Rs) Channel and, Left Surround(Ls) Channel is derived from the input audio signals having channel Lo and Ro.

6. A method for processing of audio signals comprising:

identifying a level of input audio signals, N channels of input audio signals; and outputting M channels of output audio signals by adjusting the level of the input audio signals based on a gain for each N channels of the input audio signals based on audio scene information, where N and M are integers, wherein the audio scene information is related to reproduction environment of the output audio signals, wherein the audio scene information includes output position or output level for the input audio signals.

7. The method of claim 6, wherein the channel of the output audio signals includes Center(C) Channel, Low Frequency Effect(Lfe) Channel, Left Front(Lf) Channel, Right Front(Rf) Channel, Right Surround(Rs) Channel and, Left Surround(Ls) Channel.

8. The method of claim 6, wherein the Center(C) Channel, Low Frequency Effect(Lfe) Channel, Left Front(Lf) Channel, Right Front(Rf) Channel, Right Surround(Rs) Channel and, Left Surround(Ls) Channel is derived from the input audio signals having stereo signal Lo and Ro.

* * * * *